US007601196B2

(12) United States Patent
Kawata et al.

(10) Patent No.: US 7,601,196 B2
(45) Date of Patent: Oct. 13, 2009

(54) ALLOY POWDER FOR FORMING HARD PHASE AND FERRIFEROUS MIXED POWDER USING THE SAME, AND MANUFACTURING METHOD FOR WEAR RESISTANT SINTERED ALLOY AND WEAR RESISTANT SINTERED ALLOY

(75) Inventors: Hideaki Kawata, Matsudo (JP); Koichiro Hayashi, Matsudo (JP)

(73) Assignee: Hitachi Powdered Metals Co., Ltd., Matsudo-Shi (JP)

( * ) Notice: Subject to any disclaimer, the term of this patent is extended or adjusted under 35 U.S.C. 154(b) by 428 days.

(21) Appl. No.: 11/709,691

(22) Filed: Feb. 23, 2007

(65) Prior Publication Data

US 2007/0169585 A1 Jul. 26, 2007

Related U.S. Application Data

(62) Division of application No. 10/990,548, filed on Nov. 18, 2004, now Pat. No. 7,294,167.

(30) Foreign Application Priority Data

Nov. 21, 2003 (JP) ..... 2003-391786
Nov. 21, 2003 (JP) ..... 2003-391954

(51) Int. Cl.
*B22F 3/00* (2006.01)

(52) U.S. Cl. ..... 75/246; 75/243; 428/545

(58) Field of Classification Search ..... 75/243, 75/245, 246; 428/545
See application file for complete search history.

(56) References Cited

U.S. PATENT DOCUMENTS

| | | | | |
|---|---|---|---|---|
| 3,839,024 | A | 10/1974 | Demo, Jr. et al. | |
| 4,325,994 | A | 4/1982 | Kitashima et al. | |
| 4,919,719 | A * | 4/1990 | Abe et al. | 75/243 |
| 5,952,590 | A | 9/1999 | Kawata et al. | |
| 6,066,191 | A | 5/2000 | Tanaka et al. | |
| 6,197,432 | B1 | 3/2001 | Jujita et al. | |
| 6,562,098 | B1 * | 5/2003 | Fujitsuka et al. | 75/243 |
| 0,103,753 | A1 | 6/2004 | Ando | |
| 2004/0194576 | A1 | 10/2004 | Ando et al. | |

FOREIGN PATENT DOCUMENTS

| | | | |
|---|---|---|---|
| EP | 0 882 806 | A1 | 12/1998 |
| EP | 1 405 928 | A1 | 4/2004 |
| JP | 59-37343 | B2 | 9/1984 |
| JP | A-02-163351 | | 6/1990 |
| JP | 05-55593 | B2 | 8/1993 |
| JP | 07-98985 | B2 | 10/1995 |
| JP | A-2002-356704 | | 12/2002 |
| WO | WO 02/101107 | A1 | 12/2002 |

* cited by examiner

*Primary Examiner*—Roy King
*Assistant Examiner*—Ngoclan T Mai
(74) *Attorney, Agent, or Firm*—Oliff & Berridge, PLC

(57) ABSTRACT

Alloy powder for forming a hard phase for a valve seat material having excellent high temperature wear resistance. The overall composition is consisted of Mo: 48 to 60 mass %, Cr: 3 to 12 mass % and Si: 1 to 5 mass %, and the balance of Co and inevitable impurities.

8 Claims, 22 Drawing Sheets

ALLOY POWDER FOR FORMING HARD PHASE AND FERRIFEROUS MIXED POWDER USING THE SAME, AND MANUFACTURING METHOD FOR WEAR RESISTANT SINTERED ALLOY AND WEAR RESISTANT SINTERED ALLOY

This is a Divisional of application Ser. No. 10/990,548 filed Nov. 18, 2004. The entire disclosure of the prior application is hereby incorporated by reference in its entirety.

BACKGROUND OF THE INVENTION

1. Field of the Invention

The present invention relates to a wear resistant sintered alloy used in valve seat materials for automotive engines and to a manufacturing method therefor, and more particularly, relates to a developing technology of sintered alloy which may be advantageously used in valve seats in heavy duty engine such as CNG engine or diesel engine.

2. Description of the Related Art

Recently, engines for automobile are sever in operating condition toward high performance, and valve seats are required to withstand in more extreme environmental conditions than ever. For example, in LPG engines widely used in taxicabs, contacting surfaces of valves and valve seats are used in a dry condition, and they become worn more quickly than in gasoline engines. In environments having heavy sludge deposits such as in high leaded gasoline engines with high lead content, the wear is increased by the sludge when the surface pressure on the valve seat is high or when high temperature and high compression ratio is applied such as in diesel engines. When used in such severe environments, a high strength which does not cause a phenomenon of a plastic deformation is required for high wear resistance.

On the other hand, in order to adjust the valve position and valve driving timing automatically, a dynamic valve mechanism having a lash adjuster has been developed, but the problem of engine life due to wear of valve seats is not solved sufficiently, and development of a valve seat material which is excellent in wear resistance has been demanded. More recently, aside from higher performance, development of economical and inexpensive engines is equally important, and hence the sintered alloy for valve seats must have high temperature wear resistance and high strength without requiring additional mechanisms such as a lash adjuster.

As such a sintered alloy for valve seats, Japanese Patent Publication No. S59-037343 (patent reference 1) (U.S. Pat. Nos. 4,422,875, 4,552,590) proposes to disperse Co—Mo—Si hard phase in a dappled matrix of a Fe—Co alloy and a Fe—Cr alloy. Japanese Patent Publication No. H05-0955593 (patent reference 2) proposes to disperse Co—Mo—Si hard phase in a Fe—Co alloy matrix. Japanese Patent Publication No. H07-098985 (patent reference 3) (U.S. Pat. No. 4,919,719) proposes to disperse Co—Mo—Si hard phase in a matrix adding Ni to a Fe—Co alloy. Japanese Laid-open Patent No. H02-163351(patent reference 4) proposes an Fe matrix alloy dispersing Co—Mo—Si hard phase.

Hard phase in the alloys disposed in these patent references 1 to 4 have a Mo content of 40 mass % or less, but sintered alloys containing these hard phase have considerable high temperature wear resistance and high strength. However, sintered alloys having wear resistance and high strength in high temperature are desired. For example, an improved invention discloses alloy powder for forming wear resistant hard phase consisted of Si: 1.0 to 12 mass %, Mo: 20 to 50 mass %, Mn: 0.5 to 5.0 mass %, and balance of at least one of Fe, Ni, and Co, and inevitable impurities (see Japanese Laid-open Patent No. 2002-356704, patent reference 5).

Thus, according to the demand of the times, various sintered materials with excellent wear resistance which may be favorably used as valve seat materials have been proposed. However, in recent CNG engines, heavy duty diesel engines for high output, the load on the valve seat material is much higher due to metal contact, and there is a keen desire to develop materials having high wear resistance in all severe environments.

SUMMARY OF THE INVENTION

The invention provides a wear resistant sintered member for a valve seat material exhibiting an excellent wear resistance at high temperature in environments of heavy duty engine such as in CNG engines, diesel engines, or the like, and a manufacturing method therefor.

The present inventors have analyzed the wear state in metal contact environments on the basis of the prior technical background, and discovered that the wear in environments occured metal contact is caused by plastic flow and adhesion starting from the matrix portion expected hard particles. As a countermeasure, by increasing the Mo content and growing Mo silicide material, it has been found that start points of wear can be decreased. Moreover, by increasing the Mo content and integrally precipitated Mo silicide, it has also been found that the pinning effect of hard particles can be increased. On the basis of these findings, the present inventors have concluded that the wear resistance can be enhanced substantially because occurrence of plastic flow and adhesion can be minimized.

More specifically, as the hard phase, it is a feature of the invention to select Co and eliminate Mn as the balance of the matrix disclosed in patent reference 5, thereby increasing the Mo content without increasing the hardness of the powder, and growing the precipitating Mo silicide and integrally precipitating at the same time. In this hard phase, it is also important to optimize the Si content by limiting to an extent for producing necessary Mo silicide so as to decrease the hardness of the powder and increase the Mo amount. The invention was completed on the basis of such findings.

The invention is intended to realize such countermeasures, and to provide an alloy powder for forming a hard phase, the alloy consisting of Mo: 48 to 60 mass %, Cr: 3 to 12 mass %, and Si: 1 to 5 mass %, and the balance of Co and inevitable impurities.

The invention provides a ferriferous mixed powder for wear resistant sintered alloy in which 5 to 40 mass % of the alloy powder for forming hard phase described above is added to the iron based powder mixture for forming matrix.

A manufacturing method for wear resistant sintered member of the invention includes preparing the ferriferous mixed powder for forming the wear resistant sintered alloy described above, compacting into a specified shape, and sintering the compacted powder at 1000 to 1200° C. in a non-oxidizing atmosphere. The wear resistant sintered member of the invention thus manufactured includes 5 to 40 mass % of the Co base hard phase dispersed in the iron base matrix. The Co base hard phase composes of the precipitated material mainly composed of Mo silicide integrally precipitated in the Co alloy matrix. And the Co base hard phase is consisted of Mo: 48 to 60 mass %, Cr: 3 to 12 mass %, and Si: 1 to 5 mass %, and the balance of Co and inevitable impurities.

An aspect of wear resistant sintered alloy of the invention is consisting of Mo: 5.26 to 28.47 mass %, Co: 1.15 to 19.2 mass %, Cr: 0.25 to 6.6 mass %, Si: 0.05 to 2.0 mass %, V:

0.03 to 0.9 mass %, W: 0.2 to 2.4 mass %, and C: 0.43 to 1.56 mass %, and the balance of Fe and inevitable impurities. Further, an aspect of wear resistant sintered alloy of the invention has a structure of 5 to 40 mass % of Co base hard phase and 5 to 30 mass % of Fe base hard phase are dispersed in a matrix of a bainite phase or a mixed phase of bainaite and martensite. Said Co base hard phase has a structure in which the precipitation of mainly Mo silicide is integrally precipitating in Co base alloy matrix of the Co base hard phase. Said Fe base hard phase has a structure in which granular Cr carbide, Mo carbide, V carbide and W carbide are precipitated and dispersed in the Fe base hard phase.

Another aspect of the wear resistant sintered alloy of the invention is consisting Mo: 4.87 to 28.47 mass %, Co: 1.15 to 19.2 mass %, Cr: 0.25 to 6.6 mass %, Si: 0.05 to 2.0 mass %, V: 0.03 to 0.9 mass %, W: 0.2 to 2.4 mass %, C: 0.43 to 1.56 mass %, and Ni: 13 mass % or less, and the balance of Fe and inevitable impurities. Further, another aspect of the wear resistant sintered alloy of the invention has a structure of 5 to 40 mass % of 5 to 40 mass % of Co base hard phase and 5 to 30 mass % of Fe base hard phase are dispersed in matrix of the mix phase of bainite, martensite and austenite. Said Co base hard phase has a structure in which the precipitation of mainly Mo silicide is integrally precipitating in Co base alloy matrix of Co base hard phase. Said Fe base hard phase has a structure in which granular Cr carbide, Mo carbide, V carbide, and W carbide is precipitated and dispersed in Fe base hard phase.

According to the invention, by increasing the dispersion amount of hard particles of hard phase more than in the prior art, start points of wear can be decreased, and also by integrally precipitating the hard particles, the pinning effect of hard phase can be increased, and occurrence of plastic flow and adhesion can be minimized. Therefore, the wear resistance of hard phase can be further enhanced, and the sintered alloy exhibiting an excellent high temperature wear resistance in high load engine environments can be provided.

PREFERRED EMBODIMENTS OF THE INVENTION

Figure 1:
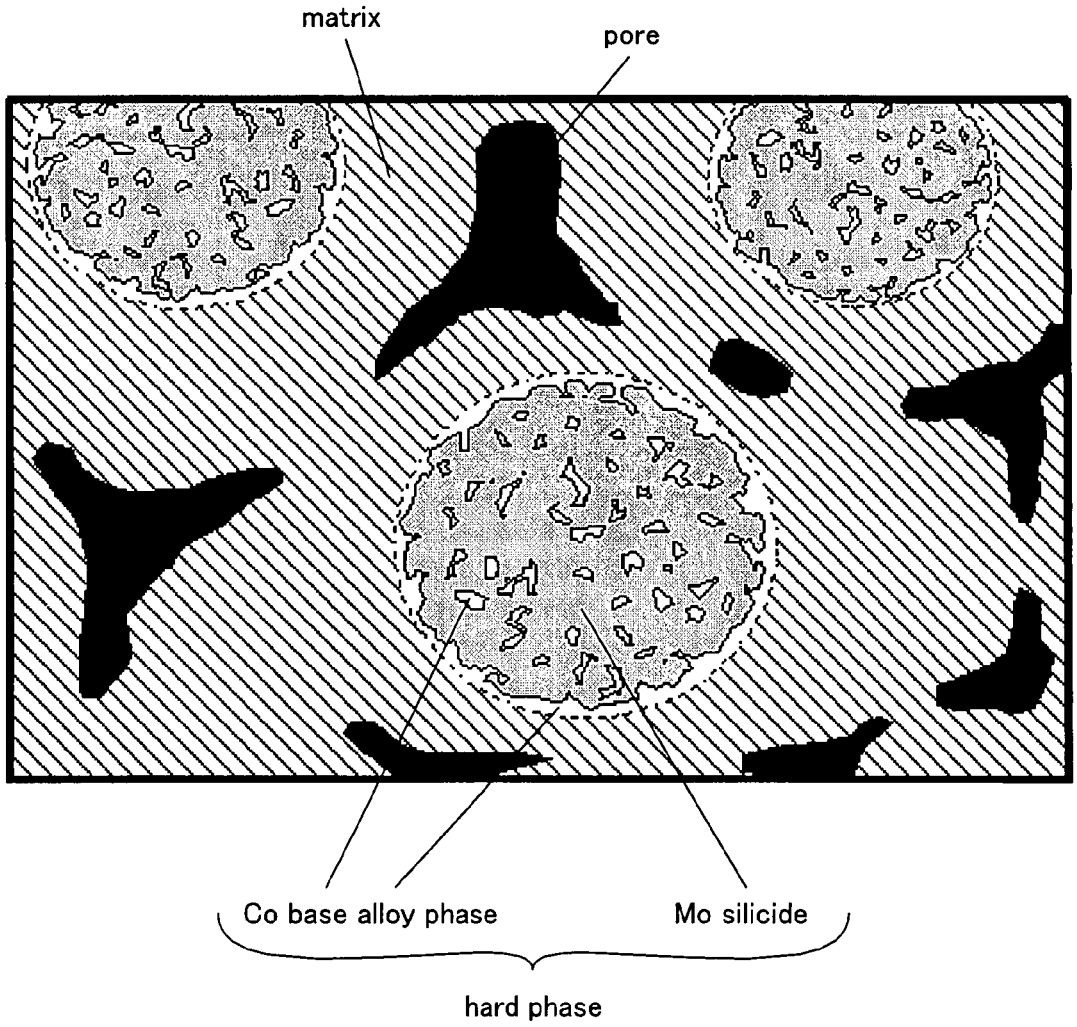
FIG. 1 is a schematic diagram of a metallographic structure of wear resistant sintered member of the invention.

Referring now to the drawings, the actions of alloy powder for forming hard phase and ferriferous mixed powder using the same, and manufacturing method for wear resistant sintered member and wear resistant sintered member of the invention are described below together with reasons for setting the numerical values.

(1) Alloy Powder for Forming Hard Phase

The alloy powder for forming the hard phase of the invention uses Co as a base material, which mainly diffuses in the Fe matrix when sintering to strengthen the Fe matrix and contribute to enhancement of fixation of hard particles, and is also effective in enhancing the heat resistance of the hard phase and its periphery. A part of Co forms Mo—Co silicide together with Mo and Si, and is also effective in enhancing the wear resistance. The reasons for limiting the chemical composition of alloy powder for forming the hard phase are explained below.

Mo: Mo is mainly bonded with Si, and forms Mo silicide which is superior in wear resistance and lubricity, thereby contributing to enhancement of wear resistance of a sintered alloy. A part of Mo incorporates Co and forms hard particles of Mo silicide. If the Mo content is less than 48 mass %, the Mo silicide is not integrated during precipitation, and granular Mo silicide disperses in Co base hard phase as in the prior art, and the wear resistance remains at the conventional level. In contract, if the Mo content exceeds 60 mass %, the effect of increased Mo becomes larger than the effect of eliminated Mn and decreased Si described below, and the hardness of the powder becomes higher, and the compactability in forming is decreased. And, the formed hard phase becomes brittle, and the hard phase may be partly broken by impact, and the broken particles act as abrasive. So the wear resistance may be rather reduced by these reasons. Hence, the Mo content is specified to be within 48 to 60 mass %.

Cr: Cr contributes to reinforcement of the Co matrix of the hard phase. It further diffuses into the Fe matrix and contributes to enhancement of wear resistance of the Fe matrix. If the Cr content is less than 3 mass %, such effects are not expected. If the Cr content exceeds 12 mass %, the amount of powder oxygen increases, and an oxide film is formed on the powder surface which impedes progress of sintering, and the powder is hardened by an oxide film, and compactability is reduced. As a result, the strength of the sintered alloy is reduced and wear resistance decreases, and hence the upper limit of Cr content is 12 mass %. Thus, the Cr content is specified to be within 3 to 12 mass %.

Si: Si mainly reacts with Mo, and forms Mo silicide which is superior in wear resistance and lubricity, and thereby contributes to enhancement of wear resistance of the sintered alloy. A certain diffusion of Si into the matrix is effective for fixation of the hard phase into the matrix. If the Si content is less than 1 mass %, sufficient Mo silicide is not formed and sufficient improving effect of wear resistance is not obtained. If the Si content is excessive, instead of reacting with Mo, large amounts of Si diffuses into the matrix. Si hardens the Fe matrix and makes it brittle. Excessive diffusion of Si is not favorable because the wear resistance of Fe matrix is reduced and atackability is increased. By decreasing the amount of Si not reacting with Mo, an appropriate Mo amount can be given without increasing the hardness of the powder. Hence, the upper limit of Si content is 5 mass % where Si diffusing into the matrix without reacting with the Mo amount begins to increase. Therefore, the Si content is specified toe be within 1 to 5 mass %.

(2) Ferriferous Mixed Powder

The ferriferous mixed powder of the invention is composed of iron base alloy powder for forming iron alloy matrix, mixed with 5 to 40 mass % of the alloy powder for forming the hard phase described above. The higher the content of the alloy powder for forming hard phase, the better the wear resistance. However, if the addition is less than 5 mass % of the overall ferriferous mixed powder, the improvement in wear resistance is not sufficient. If the addition is more than 40 mass %, the compactability of mixed powder is reduced, and density and strength after sintering are reduced, and the wear resistance decreases. Hence, the addition of alloy powder for forming a hard phase is specified to be within 5 to 40 mass %, of the overall ferriferous mixed powder. The iron base alloy powder can be selected from at least one of alloy powder, mix powder of iron powder and other elemental powder and mix powder of alloy powder.

(3) Manufacturing Method for Wear Resistant Sintered Member and Wear Resistant Sintered Member The manufacturing method for a wear resistant sintered member of the invention includes preparing alloy powder for forming a hard phase consisted of Mo: 48 to 60 mass %, Cr: 3 to 12 mass %, Si: 1 to 5 mass %, and balance: Co and inevitable impurities, adding 5 to 40 mass % of the alloy powder to a iron base alloy powder for forming an iron alloy matrix, thereby preparing a ferriferous mixed powder, compacting the ferriferous mixed powder into a specified shape, and sintering the compacted powder at 1000 to 1200° C. in a non-oxidizing atmosphere.

The reason for limiting the sintering temperature in the manufacturing method for the wear resistant sintered member is explained. The composition of iron base powder for forming the iron alloy matrix is not particularly specified, and any powder for forming a Fe alloy matrix in patent references 1 to 3 and others may be used. The iron base powder for forming the iron alloy matrix may be either an alloy powder or a mixed powder. That is, the wear resistance can be enhanced merely by replacing the Co base hard phase used in the prior art with the Co base hard phase of the invention. However, if the sintering temperature is less than 1000° C., sintering is not sufficient, and satisfactory wear resistance is not obtained. If the sintering temperature exceeds 1200° C., the hard phase is melted and lost, and necessary components for integrally precipitating the Mo silicide diffuse and flow out into the matrix, and the Mo silicide becomes precipitated material in granular form. Hence, the sintering temperature is specified to be within 1000 to 1200° C.

This manufacturing method brings about a wear resistant sintered alloy in which 5 to 40 mass % of Co base hard phase, in which a precipitated material mainly made of Mo silicide is integrally precipitated, is dispersed in a ferriferous alloy matrix of sintered member, the Co base hard phase comprising Mo: 48 to 60 mass %, Cr: 3 to 12 mass %, Si: 1 to 5 mass %, and balance of Co and inevitable impurities. In this wear resistant sintered alloy, as shown in FIG. 1, the hard phase composed of hard particles and Co base matrix. The hard particles mainly made of Mo silicide are integrally precipitated in the Co base matrix of Co alloy phase (white phase), and the Co base matrix formed in the inside and at the periphery of the hard particles. This hard phase is dispersed in the matrix of sintered member and bonded firmly to the matrix of sintered member by diffusing Co of the Co base matrix. This hard phase enhances the wear resistance by the Mo silicide which is hard and low affinity for valve as a contacting member. This hard particles which mainly made of Mo silicide are integrally precipitated, and effectively prevent the wear by pinning effect of matrix which is occurred by plastic flow or adhesion of the matrix even in the metal contact inducing environment.

Figure 2:
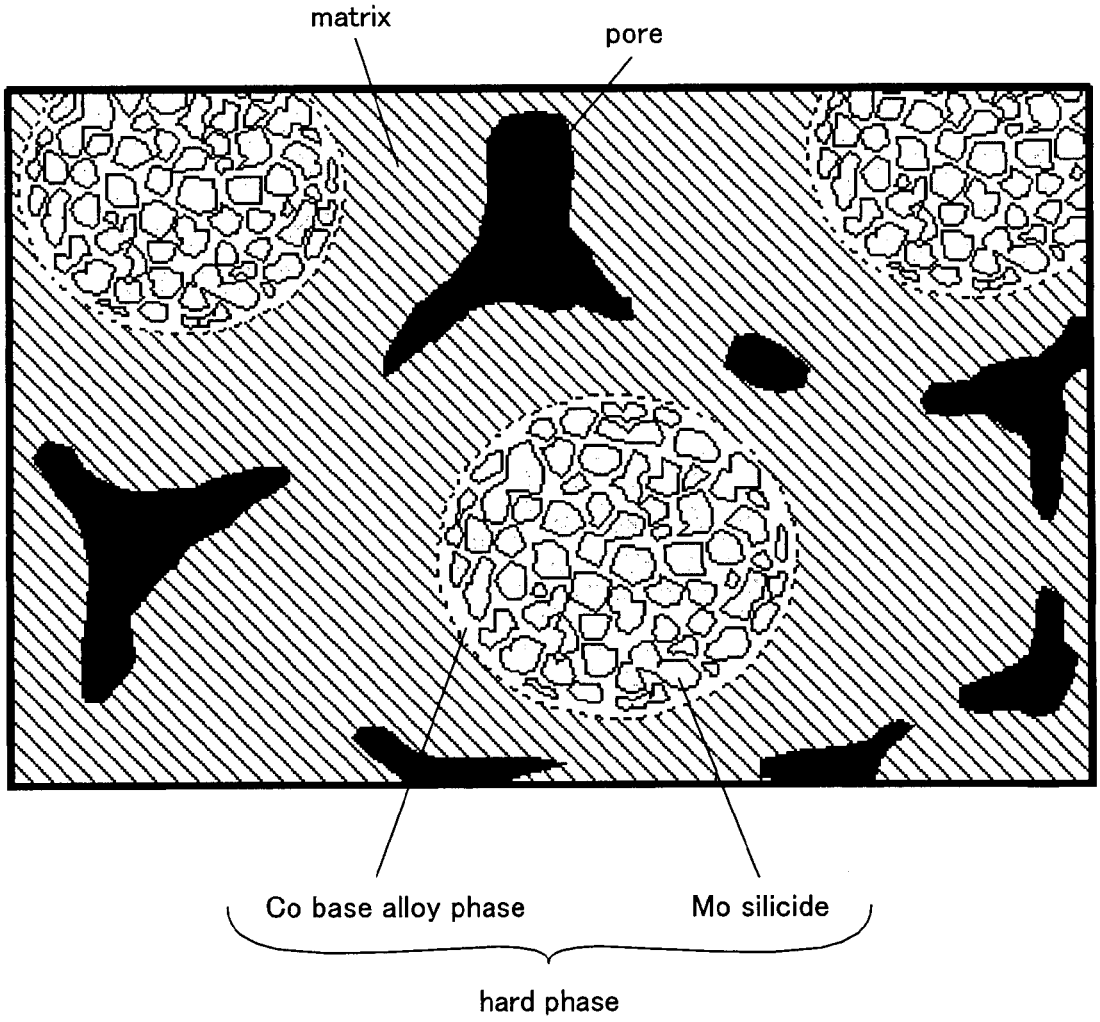
FIG. 2 is a schematic diagram of a metallographic structure of wear resistant sintered member in a prior art.

By contrast, FIG. 2 shows a schematic diagram of conventional wear resistant sintered member. In this wear resistant sintered member, a hard phase surrounded by a diffuse phase (white phase) diffusing Co around the core of granular hard particles mainly made of Mo silicide is diffused in the matrix of sintered alloy. This hard phase is hard, but is not formed by integral precipitation of hard particles of Mo silicide, the matrix pinning effect is small, and wear due to plastic flow or adhesion cannot be sufficiently prevented.

These are the actions of a wear resistant sintered member of the invention, and the actions of a wear resistant sintered alloy of the invention are described below while referring to the accompanying drawings, together with the reasons of setting the numerical values.

(1) Matrix

Figure 3:
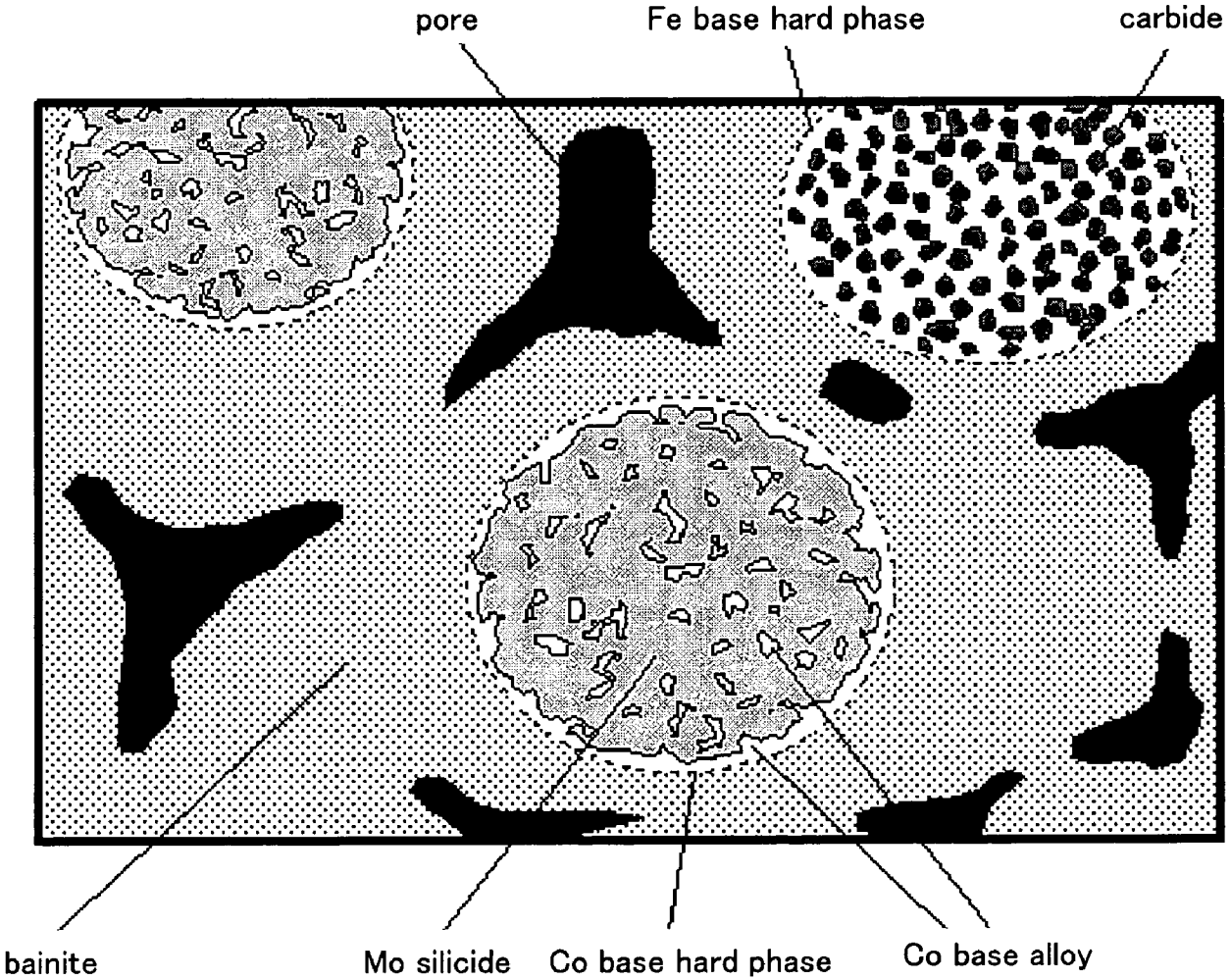
FIG. 3 is a schematic diagram of a metallographic structure of first wear resistant sintered alloy of the invention.

FIG. 3 is a schematic diagram showing a metallographic structure of the first wear resistant sintered alloy. As shown in the diagram, the matrix structure of this sintered alloy is mainly composed of bainite. Martensite has a hard and strong structure and is effective for enhancing the wear resistance, but because of its hardness, it promotes wear of the valve as a contacting member. Matrix structure is mainly composed of Bainite which is not as hard as martensite and is hard and strong next to martensite. Therefore, Bainaite can decrease the damage to the contacting member while preventing plastic flow of the matrix. Bainite may be used alone, or martensite may be dispersed in the matrix structure of bainite in order to further enhance the wear resistance. The wear resistance is further improved by dispersing the hard phase of the invention in the matrix of bainite single phase or bainite and martensite mixed phase having excellent wear resistance.

To obtain such a matrix, as the matrix component, an iron base alloy containing Mo by 3 to 7 mass % is suitable, and it is provided in a form of iron base alloy powder (alloy powder A). Mo is solved by solid solution in an iron matrix, and acts to expand the bainite region, and contributes to bainite formation of a matrix structure at ordinary cooling rates after sintering. However, if the amount of Mo is less than 3 mass % of iron base alloy powder, its action becomes poor, or if it exceeds 7 mass %, the alloy powder becomes harder and compactability is worsened.

Figure 4:
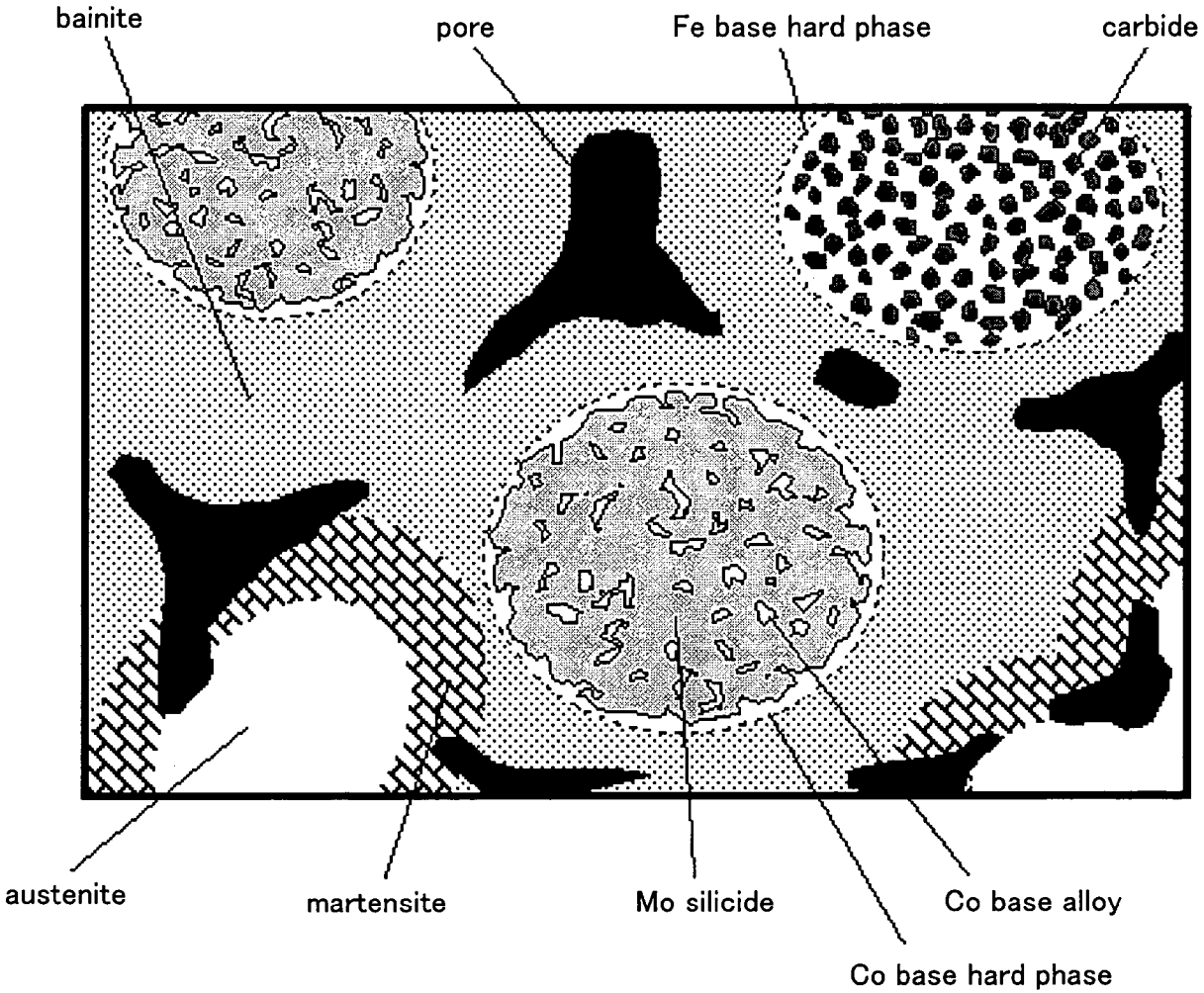
FIG. 4 is a schematic diagram of a metallographic structure of second wear resistant sintered alloy of the invention.

On the other hand, FIG. 4 is a schematic diagram showing a metallographic structure of the second wear resistant sintered alloy. As shown in the diagram, the matrix of this wear resistant sintered alloy is a mixed structure of martensite with high strength and austenite with high toughness dispersed in bainite. In this structure, the tough austenite lessens the atackability of martensite, and the soft and plastically flowing austenite is reinforced by the martensite of high strength and having matrix plastic flow preventive effect, and they have mutually complementary effects, and a further improving effect of wear resistance is obtained.

Such a matrix structure can be obtained by adding Ni powder to the iron base alloy powder containing Mo (alloy powder A). That is, in the sintering process, Ni diffusing into the iron matrix from Ni powder presents a concentration profile of high Ni concentration in the original Ni powder portion, and decreasing concentration as moving away from the original Ni powder portion. Ni has an action improving hardenability, in the Ni diffusing region, it is transformed into a martensite structure in the cooling process after sintering, the high Ni concentration portion remains as austenite even at ordinary temperature, thereby forming this matrix structure. However, if the added amount of Ni powder is more than 13 mass %, the remaining austenite amount is excessive, and the Ni diffusion amount is too large, and the bainite structure does not remain, and hence the upper limit must be set at 13 mass %.

(2) Hard Phase

In either one of the first and second wear resistant sintered alloys of the invention, as shown in FIG. 3 and FIG. 4, hard phase (first hard phase) is dispersed in the matrix of sintered alloy. The hard phase (first hard phase) is composed of hard particles which mainly made of integrally precipitated Mo silicide and Co alloy phase (white phase) which is formed in the inside and at the periphery of the integrally precipitated Mo silicide. The hard phase is bonded firmly to the matrix of sintered alloy by diffusing Co of the Co alloy phase. This hard phase enhances the wear resistance by the Mo silicide which is hard and low in affinity with the contacting member of a valve. This hard phase effectively prevent the wear by matrix pinning effect which is occurred plastic flow or adhesion of the matrix even in a metal contact inducing environment, since hard particles mainly made of Mo silicide are integrally precipitated.

In either one of the first and second wear resistant sintered alloys of the invention, an Fe base hard phase (second hard phase) is diffused dispersed in the matrix of sintered alloy. In the Fe base hard phase (second hard phase), granular Cr carbide, Mo carbide, V carbide, and W carbide are mainly precipitated. Fe base alloy matrix of Fe base hard phase is formed in the periphery of these carbides. This hard phase is a composition known as Molybdenum high speed steel.

Among such hard phases, the Co base hard phase provides an extremely superior wear resistance when dispersed in the matrix at 5 to 40 mass %. If it is less than 5 mass %, the improving effect of wear resistance is not sufficient, or if it exceeds 40 mass %, the compactability of the mixed powder is reduced, and the atackability becomes higher, and the wear amount undesirably increases. Similarly, the Fe base hard phase provides an extremely superior wear resistance when dispersed in the matrix at 5 to 30 mass %. If it is less than 5 mass %, the improving effect of wear resistance is not sufficient, or if it exceeds 30 mass %, the compactability of mixed powder is reduced, and the atackability becomes higher, and the wear amount undesirably increases.

The reasons for limiting the chemical composition are explained below.

Mo: Mo is solved by a solid solution in the matrix to strengthen the matrix, and expands the bainite region of the matrix, and functions to transform the matrix into bainite by ordinary cooling after sintering, without requiring any particular isothermal treatment. By such functions, Mo contributes to enhancement of strength and wear resistance of the matrix of sintered alloy. In the first hard phase, Mo forms a hard silicide together with Si, and partly reacts with Co to form Mo—Co silicide, and these Mo silicides are integrally precipitated to form cores of hard phase to prevent plastic flow and adhesion of matrix, thereby contributing to enhancement of wear resistance. In the second hard phase, Mo forms granular Mo carbides to contribute to enhancement of wear resistance.

If the content of Mo is less than 3 mass % as the amount provided as a solid solution in the matrix, bainite formation of matrix is not sufficient, and the strength and wear resistance are insufficient. If the amount in the first hard phase is less than 48 mass %, the Mo silicide is not integrally precipitated, but is precipitated as Mo silicide portion, and the wear resistance is reduced. If the amount in the second hard phase is less than 4 mass %, the forming amount of Mo carbide becomes insufficient, and the wear resistance is reduced. The lower limit of the amount of Mo in the overall composition is 5.26 mass % in the first wear resistant sintered alloy, and 4.87 mass % in the second wear resistant sintered alloy.

On the other hand, if the amount given as a solid solution in the matrix is more than 7 mass %, and the amount in the first hard phase is more than 60 mass %, and the amount in the second hard phase is more than 8 mass %, the material powder as the supply source is too hard and the compactability is reduced, and the density of forming is reduced, and the density is not increased after sintering, and the strength and wear resistance are reduced. In the overall composition, the upper limit of the Mo amount is 28.47 mass %.

Therefore, the Mo content is specified to be within 5.26 to 28.47 mass % in the first wear resistant sintered alloy, and 4.87 to 28.47 mass % in the second wear resistant sintered alloy.

Co: Co in the first hard phase diffuses in the matrix to reinforce by the solid solution of the matrix of sintered alloy, and functions to bond the hard phase firmly to the matrix. The Co diffusing into the matrix strengthens the matrix, and also acts to improve the heat resistance of the matrix of sintered alloy and the hard phase. In addition, some of the Co forms Mo—Co silicide together with Mo and Si, and forms the core of the hard phase to prevent plastic flow and adhesion of the matrix, thereby contributing to enhancement of wear resistance. If the content of Co exceeds 19.2 mass %, the powder of the supply source becomes hard, and the compactability is decreased. The lower limit is 1.15 mass %. If it is lower than this lower limit, the effect is not sufficient. Hence, the content of Co is specified to be within 1.15 to 19.2 mass %.

Cr: Cr in the first hard phase is solved by a solid solution in the Co matrix of the first hard phase and acts to strengthen. Cr in the second hard phase forms carbide and contributes to enhancement of wear resistance of the matrix. Further, Cr diffusing into the matrix from the first and second hard phases bonds the hard phase firmly to the matrix of sintered alloy, and is solved by a solid solution in the matrix to strengthen the matrix further, and functions to enhance the hardenability further. The effect is not sufficient if the content of Cr is less than 3 mass % in the first hard phase, or less than 2 mass % in the second hard phase. The lower limit of the Co amount in the overall composition is 0.25 mass %. On the other hand, if the amount in the first hard phase is more than 12 mass % and the amount in the second hard phase is more than 6 mass %, the powder of the supply source becomes hard, and the compactability is decreased. Hence, the upper limit of Cr amount in the overall composition is 6.6 mass %. The content of Cr is specified within 0.25 to 6.6 mass %.

Si: Si is compounded with Mo and Co in the first hard phase as mentioned above, and forms hard Mo silicide and Mo—Co silicide, and contributes to enhancement of wear resistance. If the content of Si is less than 0.05 mass %, sufficient amount of silicide is not precipitated, or if it exceeds 2.0 mass %, the powder of the supply source becomes hard, and the compactability is decreased, and the sintering property is worsened. Hence, the content of Si is specified to be within 0.05 to 2.0 mass %.

V: V forms a fine V carbide in the second hard phase to contribute to enhancement of wear resistance, and partly diffuses into the matrix to strengthen by the solid solution. If the content of V is less than 0.03 mass %, the effect is insufficient. If it exceeds 0.9 mass %, the powder of the supply source becomes hard and the compactability is decreased. Hence, the content of V is specified within 0.03 to 0.9 mass %.

W: Like V, W also forms carbide in the second hard phase to contribute to enhancement of wear resistance. If the content of W is less than 0.2 mass %, the effect is insufficient. If it exceeds 2.4 mass %, the powder of the supply source becomes hard and the compactability is decreased. Hence, the content of W is specified toe be within 0.2 to 2.4 mass %.

C: C functions to strengthen the matrix of the sintered alloy, and contributes to formation of bainite, martensite and austenite in the matrix structure, thereby enhancing the wear resistance. In the second hard phase, as mentioned above, it forms granular carbides and granular mixed carbides of Mo, Cr, V, and W, and contributes to enhancement of wear resistance. If the content of C is less than 0.43 mass %, ferrite having low wear resistance and low strength remains in the matrix structure, and improvement of wear resistance is not sufficient. If the content of C exceeds 1.56 mass %, cementite begins to precipitate in the grain boundary, and the strength is reduced. Hence, the content of C is specified to be within 0.43 to 1.56 mass %.

Ni: By addition of a small amount thereof, Ni contributes to reinforce the matrix by the solid solution, and improves the hardenability of the matrix structure, and promotes formation of martensite at cooling rate after sintering to contribute to enhancement of wear resistance. A high concentration portion of Ni remains as austenite. Since the austenite structure is soft and tough, austenite effectively suppresses attack on the contacting member. In the second sintered alloy of the invention, it is required to form bainite or a mixed structure of martensite and austenite in addition to bainite, and a certain quantity of Ni is needed. However, excessive Ni content may cause excessive formation of tough and soft austenite, and plastic flow or adhesion of the matrix may be easily to occur, or bainite may not remain in the matrix structure, and the wear resistance may be reduced. Hence, the upper limit of Ni content is 13 mass %. In the wear resistant sintered alloy of the invention, Ni is contained in the second wear resistant sintered alloy only.

Herein, the first or second wear resistant sintered alloy has a metallographic structure in which 0.3 to 2.0 mass % of at least one type of machinability improving particles selected from the group consisting of lead, molybdenum disulfide, manganese sulfide, boron nitride, magnesium metasilicate mineral, and calcium fluoride is preferably dispersed. These are machinability improving components, and by dispersing in the matrix, they become starting points of breaking during machining, so that the machinability of the sintered alloy can be improved. If the content of such machinability improving components is less than 0.3 mass %, the effect is insufficient, or if it is contained at more than 2.0 mass %, the strength of the sintered alloy is reduced. Hence, the content is specified to be within 0.3 to 2.0 mass %.

In the wear resistant sintered alloy of the invention, preferably, at least one type selected from the group consisting of lead, lead alloy, copper, copper alloy and acrylic resin should be infiltrated or impregnated in the pores. They are also machinability improving components. In particular, when a porous sintered alloy is machined, machining condition is intermittent, but when pores are filled with lead or copper, cutting condition is continuous, and impact on the tip of the tool is reduced. The lead also functions as a solid lubricant, and the copper or copper alloy is high in heat conductivity and prevents gathering of heat, and lessens heat damage of the tool tip, and the acrylic resin acts as start points of cutting tip breaking.

The manufacturing method for first and second wear resistant sintered alloys of the invention is described below.

The manufacturing method for the first wear resistant sintered alloy includes preparing a mixed powder of alloy powder A for forming a matrix consisted of Mo: 3 to 7 mass % and balance: Fe and inevitable impurities, added 5 to 40 mass % of alloy powder B for forming Co base hard phase consisted of Mo: 48 to 60 mass %, Cr: 3 to 12 mass %, Si: 1 to 5 mass %, and balance: Co and inevitable impurities, 5 to 30 mass % of alloy powder C for forming Fe base hard phase consisted of Mo: 4 to 8 mass %, V: 0.5 to 3 mass %, W: 4 to 8 mass %, Cr: 2 to 6 mass %, C: 0.6 to 1.2 mass %, and balance: Fe and inevitable impurities, and 0.3 to 1.2 mass % of graphite powder, compacting the mixed powder into a specified shape, and sintering the compacted powder at 1000 to 1200° C. in a non-oxidizing atmosphere.

The manufacturing method for the second wear resistant sintered alloy includes preparing a mixed powder of alloy powder A for forming a matrix consisted of Mo: 3 to 7 mass % and balance: Fe and inevitable impurities, added 5 to 40 mass % of alloy powder B for forming Co base hard phase consisted of Mo: 48 to 60 mass %, Cr: 3 to 12 mass %, Si: 1 to 5 mass %, and balance: Co and inevitable impurities, 5 to 30 mass % of alloy powder C for forming Fe base hard phase consisted of Mo: 4 to 8 mass %, V: 0.5 to 3 mass %, W: 4 to 8 mass %, Cr: 2 to 6 mass %, C: 0.6 to 1.2 mass %, and balance: Fe and inevitable impurities, 13 mass % or less of Ni powder, and 0.3 to 1.2 mass % of graphite powder, compacting the mixed powder into a specified shape, and sintering the compacted powder at 1000 to 1200° C. in a non-oxidizing atmosphere.

The elements of these powder materials and the reasons for limiting the contents of the elements are described below in the order of powder for forming the matrix and the mixed powder.

(1) Power for Forming Matrix

Alloy Powder A

Mo: Mo is an element which facilitates formation of a bainite structure at cooling rate in a furnace after sintering, and forms Mo carbide to contribute to enhancement of wear resistance. Mo is also effective in increasing the resistance to temper softening of the matrix, and it is effective to prevent plastic deformation during use in the case of a sintered alloy for a valve seat repeated heating and cooling. If the content of Mo is less than 3 mass %, such effects are insufficient, and pearlite remains in the matrix structure, and the effect of enhancing the wear resistance becomes poor. If the content of Mo exceeds 7 mass %, these effects becomes extremely and Mo carbide in hypereutectoid region is easily to precipitate, and machinability is reduced and atackability is increased. The content of Mo is specified to be within 3 to 7 mass %. In order to enhance these actions of Mo uniformly on the entire matrix, Mo is preferred to be given in a form of Fe—Mo alloy powder.

(2) Powder for Mixing

In order to disperse the hard phase and provide wear resistance in the matrix formed of alloy powder A, alloy powder B made of Co base alloy, alloy powder C made of Fe base alloy, and graphite powder are prepared as powder for mixing. When manufacturing the second wear resistant sintered alloy, Ni powder is further prepared.

Alloy Powder B (for Forming Co Base Hard Phase)

Co: Co diffuses in a matrix to bond the hard phase firmly to the matrix. Diffusing in the matrix, Co strengthens the matrix of sintered alloy, and also acts to improve the heat resistance of the matrix of sintered alloy and matrix of the hard phase. Part of Co forms, together with Mo and Si, Mo—Co silicide, and this silicide becomes the core of the hard phase to contribute to enhancement of wear resistance, and also by the pinning effect, plastic flow or adhesion of matrix can be prevented. Hence, alloy powder B is composed of Co alloy powder. Reasons for limiting the chemical composition contained in the alloy powder B and mixing ratio of alloy powder B are explained below.

Mo: Mo is mainly bonded with Si, and forms integrally Mo silicide which is superior in wear resistance and lubricity, thereby contributing to enhancement of wear resistance of the sintered alloy. In part, Mo incorporates also Co and forms hard particles of Mo—Co silicide. If the Mo content in the alloy powder B is less than 48 mass %, the Mo silicide is not integrated and is granulated in precipitation, and the wear resistance remains at the conventional level. In contrast, if the Co content in alloy powder B exceeds 60 mass %, the effect of increment of Mo is promoted, and the hardness of the powder becomes higher, and the compactability in forming is decreased. At the same time, the formed hard phase becomes brittle, and it may be partly broken by impact, and the wear resistance may be somewhat reduced by the action of the abrasive. Hence, the Mo content in alloy powder B is specified to be within 48 to 60 mass %.

Cr: Cr contributes to reinforcement of the Co matrix of the hard phase. It further diffuses into the Fe matrix of sintered alloy, and contributes to enhancement of wear resistance of the Fe matrix of sintered alloy. If the Cr content in alloy powder B is less than 3 mass %, such effects becomes If the Cr content exceeds 12 mass %, the amount of powder oxygen increases, and an oxide film is formed on the powder surface to impede progress of sintering, and the powder is hardened by the oxide film, and compactability is reduced. As a result, the strength of sintered alloy is reduced and wear resistance decreases, and hence the upper limit of Cr content is 12 mass %. Thus, the Cr content in the alloy powder B is specified to be within 3 to 12 mass %.

Si: Si mainly reacts with Mo, and forms Mo silicide which is superior in wear resistance and lubricity, and thereby contributes to enhancement of wear resistance of the sintered alloy. A certain diffusion of Si into the matrix is effective for fixation of the hard phase into the matrix. If the Si content in the alloy powder B is less than 1 mass %, sufficient Mo silicide is not precipitated, and sufficient improving effect of wear resistance is not obtained. If the Si content is excessive, instead of reacting with Mo, a large amount of Si diffuses into the matrix of sintered alloy. Si hardens the Fe matrix and makes it brittle at the same time. Excessive diffusion of Si is not desirable because the wear resistance of Fe matrix of sintered alloy is reduced and atackability is increased. By decreasing the amount of Si not reacting with Mo, an appropriate amount of Mo can be given without increasing the hardness of the powder. Hence, the upper limit of Si content is 5 mass % where Si diffusing into the matrix without reacting with Mo amount begins to increase. Therefore, the Si content is specified to be within 1 to 5 mass %.

The addition amount of alloy powder B is explained. As mentioned above, the hard phase by alloy powder B is firmly bonded to the matrix, and the original powder portion is integrated with hard particles mainly made of Mo silicide and also forming a precipitating structure of Co alloy phase (white phase) of high Co and Cr concentration in the inside and at the periphery of hard particles, thereby forming a hard phase. The higher the content of alloy powder B, the better the wear resistance. However, if the addition is less than 5 mass % of the overall mixed powder, the pinning effect of the matrix of sintered alloy is insufficient in the metal contact inducing environment, and plastic flow or adhesion of matrix of sintered alloy occurs, which promotes wear, and the improving effect of wear resistance becomes poor. In contrast, if the amount exceeds 40 mass %, the compactability of the mixed powder is low, and the density and strength after sintering decrease, and the wear resistance also decreased. Hence, the amount of alloy powder B in the overall mixed powder is specified to be within 5 to 40 mass %.

Alloy Powder C (for Forming Fe Base Hard Phase)

Fe: Herein, Fe is the matrix of a so-called Molybdenum high speed steel, and contributes to enhancement of wear resistance. Hence, alloy powder C is composed of Fe base alloy. Reasons for limiting the chemical composition contained in alloy powder C and mixing ratio of alloy powder C are explained below.

Mo: Mo forms carbide and contributes to enhancement of wear resistance. It further diffuses into the matrix of sintered alloy and functions to increase fixation of the hard phase to the matrix. If the Mo content in alloy powder C is less than 4 mass %, the amount of precipitating Mo carbide is insufficient, and the wear resistance improving effect becomes poor. In contrast, if the content exceeds 8 mass %, the amount of precipitating Mo carbide becomes excessive, and the atackability is increased, and the machinability is extremely reduced. Hence, the Mo content in alloy powder C is specified to be within 4 to 8 mass %.

V: V forms hard and fine V carbide particles, and contributes to enhancement of wear resistance. This effect is prominent when the V content in alloy powder C is 0.5 mass % or more, but if it exceeds 3 mass %, the amount of precipitating V carbide is excessive, and the atackability is increased, and the machinability is extremely reduced. Hence, the V content in alloy powder C is specified to be within 0.5 to 3 mass %.

W: V forms hard W carbide particles and contributes to enhancement of wear resistance. If the W content in alloy powder C is less than 4 mass %, the amount of precipitating W carbide is insufficient, and the wear resistance improving effect becomes poor. However, it exceeds 8 mass %, the amount of precipitating W carbide is excessive, the atackability is increased, and the machinability is extremely reduced. Hence, the W content in alloy powder C is specified to be within 4 to 8 mass %.

Cr: Cr forms a carbide and contributes to enhancement of wear resistance. It further diffuses into the matrix atackability to reinforce fixation of the hard phase to the matrix, and improves the hardenability of the matrix to transform the matrix structure into martensite in the cooling process after sintering, thereby enhancing the wear resistance of the matrix. If the Cr content in alloy powder C is less than 2 mass %, the amount of precipitating Cr carbide is insufficient, and the improving effect of wear resistance is not sufficient. If it exceeds 6 mass %, the amount of precipitating Cr carbide becomes too large, and the atackability is increased, and the machinability is extremely reduced. Hence, the Cr content in alloy powder C is specified to be within 2 to 6 mass %.

C: When these alloy components are given to the Fe alloy powder in the form of a solid solution, the powder becomes too hard, and the compactability is extremely reduced. Accordingly, C is added to the Fe base alloy powder, and part of the alloy components forming the solid solution in the Fe alloy powder is caused to precipitate in the form of a carbide. As a result, carbide is precipitated and disperses in the Fe base alloy powder, but the alloy components solved by a solid solution in the matrix portion of the Fe alloy powder are decreased. Hence, in the overall Fe base alloy powder, the hardness of the powder is reduced, and the compactability is improved. If the content of C in the C alloy powder given to the Fe base alloy is less than 0.6 mass %, the amount of precipitating carbide becomes small, and the improvement of compactability is not sufficient. If it is provided at more than 1.2 mass %, the amount of carbide precipitating in the Fe base alloy powder becomes too large, and the compactability decreased. Hence, the content of C in alloy powder C is specified to be within 0.6 to 1.2 mass %.

The amount of addition of alloy powder C is explained. When alloy powder C is dispersed in the matrix at 5 to 30 mass %, an extremely superior wear resistance is exhibited. If the amount of alloy powder C in the total mass of mixed powder is less than 5 mass %, the improving effect of wear resistance is not sufficient, and it exceeds 30 mass %, the compactability of mixed powder is reduced, the atackability is higher, and the amount of wear increases. Hence, the amount of alloy powder C in the overall mass of mixed powder is specified to be within 5 to 30 mass %.

Ni Powder

Ni reinforces the matrix by a solid solution, and it is added to make it easier to form martensite at ordinary cooling rate after sintering. When Ni is given in a form of solid solution in Fe—Mo alloy powder, Ni is uniform, and bainite single-phase structure is easily obtained. If Ni is given as a single powder or is partly dispersed in Fe—Mo alloy powder, high Ni concentration parts are dispersed in the matrix. The portion diffused Ni are transformed into martensite, and martensite is easily to be dispersed in the bainite structure. If used as a single powder, the original Ni powder portion is high in Ni concentration, and remains as tough austenite, and functions to enhance the toughness of the matrix. However, if austenite disperses excessively, the wear resistance is reduced, and the Ni content should be controlled to within 13 mass % of the overall mass of the mixed powder. In the wear resistant sintered alloy of the invention, Ni is contained only in the second wear resistant sintered alloy.

Graphite Powder

When C is added to alloy power A for forming matrix in the form of a solid solution, the alloy power becomes hard and the compactability decreases, and therefore it is added in the form of graphite. When added in the form of graphite, C strengthens the matrix of sintered alloy and enhances the wear resistance. Further, part of graphite powder forms carbide of Cr, Mo, V and W in alloy powder C and/or mixed carbide of them. If the amount of C is less than 0.3 mass %, ferrite which is low in wear resistance and strength is remained in the matrix structure, and if it exceeds 1.2 mass %, cementite begins to precipitate in the grain boundary, and the strength is reduced. Hence, the addition of graphite is specified to be within 0.3 to 1.2 mass % for the mass of alloy powder A for forming the matrix.

The first wear resistant sintered member of the invention manufactured by using specified amounts of alloy powder A, alloy powder B, alloy powder C, and graphite powder. In the first wear resistant sintered member, overall composition is that Mo: 5.26 to 28.47 mass %, Co: 1.15 to 19.2 mass %, Cr: 0.25 to 6.6 mass %, Si: 0.05 to 2.0 mass %, V: 0.03 to 0.9 mass %, W: 0.2 to 2.4 mass %, and C: 0.43 to 1.56 mass %, and the balance of Fe and inevitable impurities. Further, in the first wear resistant sintered member, 5 to 40 mass % of Co base hard phase and 5 to 30 mass % of Fe base hard phase are dispersed in matrix structure composed of bainite phase or mixed phase of bainite and martensite. The Co base hard phase includes the precipitated material mainly composed of Mo silicide integrally precipitated in the Co base hard phase. The Fe base hard phase includes granular Cr carbide, Mo carbide, V carbide, and W carbide precipitated in the Fe base hard phase.

The second wear resistant sintered member of the invention manufactured by using specified amounts of alloy powder A, alloy powder B, alloy powder C, Ni powder, and graphite powder. Further, in the second wear resistant sintered member, overall composition is that Mo: 4.87 to 28.47 mass %, Co: 1.15 to 19.2 mass %, Cr: 0.25 to 6.6 mass %, Si: 0.05 to 2.0 mass %, V: 0.03 to 0.9 mass %, W: 0.2 to 2.4 mass %, C: 0.43 to 1.56 mass %, and Ni: 13 mass % or less, and the balance of Fe and inevitable impurities. In the second wear resistant sintered member, 5 to 40 mass % of Co base hard phase and 5 to 30 mass % of Fe base hard phase are dispersed in matrix structure composed of bainite phase or mixed phase of martensite and austenite. The Co base hard phase includes the precipitated material mainly composed of Mo silicide integrally precipitated in the Co base hard phase. The Fe base hard phase includes granular Cr carbide, Mo carbide, V carbide, and W carbide precipitated in the Fe base hard phase.

In the manufacturing method for the first and second wear resistant sintered alloys of the invention, preferred additive elements are explained below.

(1) Addition of Lead, Molybdenum Disulfide, Manganese Sulfide, Boron Nitride, Magnesium Metasilicate Mineral, and Calcium Fluoride Powder To improve the machinability of the wear resistant sintered alloy of the invention, the mixed powder may comprise at least one type selected from the group consisting of lead powder, molybdenum disulfide powder, manganese sulfide powder, boron nitride powder, magnesium metasilicate mineral powder, and calcium fluoride powder, by 0.3 to 2.0 mass % of the mixed powder. The reasons for limiting the contents of the additives are the same as explained earlier.

(2) Infiltration or Impregnation of Lead, Lead Alloy, Copper, Copper Alloy, and Acrylic Resin In the pores of the wear resistant sintered alloy of the invention manufactured in this manufacturing method, lead, lead alloy, copper, copper alloy, and acrylic resin can be infiltrated or impregnated. More specifically, by adding powder of lead or copper in the mixed powder, and sintering the powder formed body, these metals are melt and filled (infiltrated) in the pores. Alternatively, by filling a closed container with fused acrylic resin or wear resistant sintered alloy, and evacuating the closed container, the pores may be filled with acrylic resin (impregnated). Instead of acrylic resin, by using fused lead or copper or copper alloy, these metals can also be infiltrated in the pores.

EMBODIMENTS

Embodiment 1

Effects of Composition of Alloy Powder for Forming Hard Phase

As alloy powder for forming matrix, alloy powder of Fe-6.5Co-1.5Mo—Ni disclosed in patent reference 2 was prepared, and the alloy powder for forming the hard phase in the composition shown in Table 1 was added and mixed by 25 mass %, together with 1.1 mass % of graphite powder and forming lubricant (0.8 mass % of zinc stearate), and the mixed powder was formed in a ring of ϕ30 (mm)×ϕ20 (mm)×h10 (mm) at forming pressure of 650 MPa.

TABLE1

| Sample | Composition of alloy powder for forming hard phase, mass % | | | | Wear amount μm | | | |
|---|---|---|---|---|---|---|---|---|
| No. | Co | Mo | Cr | Si | Valve seat | Valve | Total | Remarks |
| 01 | Balance | 45.0 | 10.0 | 3.0 | 150 | 25 | 175 | Out of scope of invention |
| 02 | Balance | 48.0 | 10.0 | 3.0 | 110 | 8 | 118 | |
| 03 | Balance | 50.0 | 10.0 | 3.0 | 85 | 5 | 90 | |
| 04 | Balance | 55.0 | 10.0 | 3.0 | 80 | 5 | 85 | |
| 05 | Balance | 60.0 | 10.0 | 3.0 | 90 | 9 | 99 | |
| 06 | Balance | 65.0 | 10.0 | 3.0 | 165 | 38 | 203 | Out of scope of invention |
| 07 | Balance | 50.0 | 0.0 | 3.0 | 180 | 0 | 180 | Out of scope of invention |
| 08 | Balance | 50.0 | 3.0 | 3.0 | 120 | 1 | 121 | |
| 09 | Balance | 50.0 | 5.0 | 3.0 | 92 | 3 | 95 | |
| 10 | Balance | 50.0 | 12.0 | 3.0 | 105 | 5 | 110 | |
| 11 | Balance | 50.0 | 15.0 | 3.0 | 165 | 10 | 175 | Out of scope of invention |
| 12 | Balance | 50.0 | 10.0 | 0.0 | 250 | 0 | 250 | Out of scope of invention |
| 13 | Balance | 50.0 | 10.0 | 1.0 | 101 | 2 | 103 | |
| 14 | Balance | 50.0 | 10.0 | 5.0 | 75 | 6 | 81 | |
| 15 | Balance | 50.0 | 10.0 | 7.0 | 200 | 8 | 208 | Out of scope of invention |
| 16 | Balance | 28.0 | 8.0 | 2.5 | 149 | 23 | 172 | Prior art |

These formed bodies were sintered at 1180° C. for 60 minutes in an decomposed ammonia gas atmosphere, and samples 01 to 16 were prepared. In these samples, simplified wear tests were conducted, and the results are shown in Table 1.

The simplified wear tests were conducted in the loaded state of striking and contacting at high temperature. More specifically, the ring test piece was processed into a valve seat shape having a slope of 45 degrees at the inner side, and the sintered alloy was press-fitted into an aluminum alloy housing. On an outer surface made of SUH-36 which was heat resisting steel defined by the JIS (Japan Industrial Standards), a circular contacting member (valve) partially having a slope of 45 degrees was driven by motor, and vertical piston motions were caused by rotation of an eccentric cam, and sloped sides of the sintered alloy and contacting member were repeatedly contacted. That is, valve motions are repeated actions of releasing motion of departing from the valve seat by the eccentric cam rotated by motor driving, and contacting motion on the valve seat by the valve spring, and vertical piston motions are realized. In this test, the contacting member was heated by a burner and the temperature was set to the sintered alloy temperature of 300° C., and strike operations in the simplified wear test were 2800 times/minute, and the duration was 15 hours. In this manner, the wear of the valve seats and the wear of valves after the tests were measured and evaluated.

Figure 5:
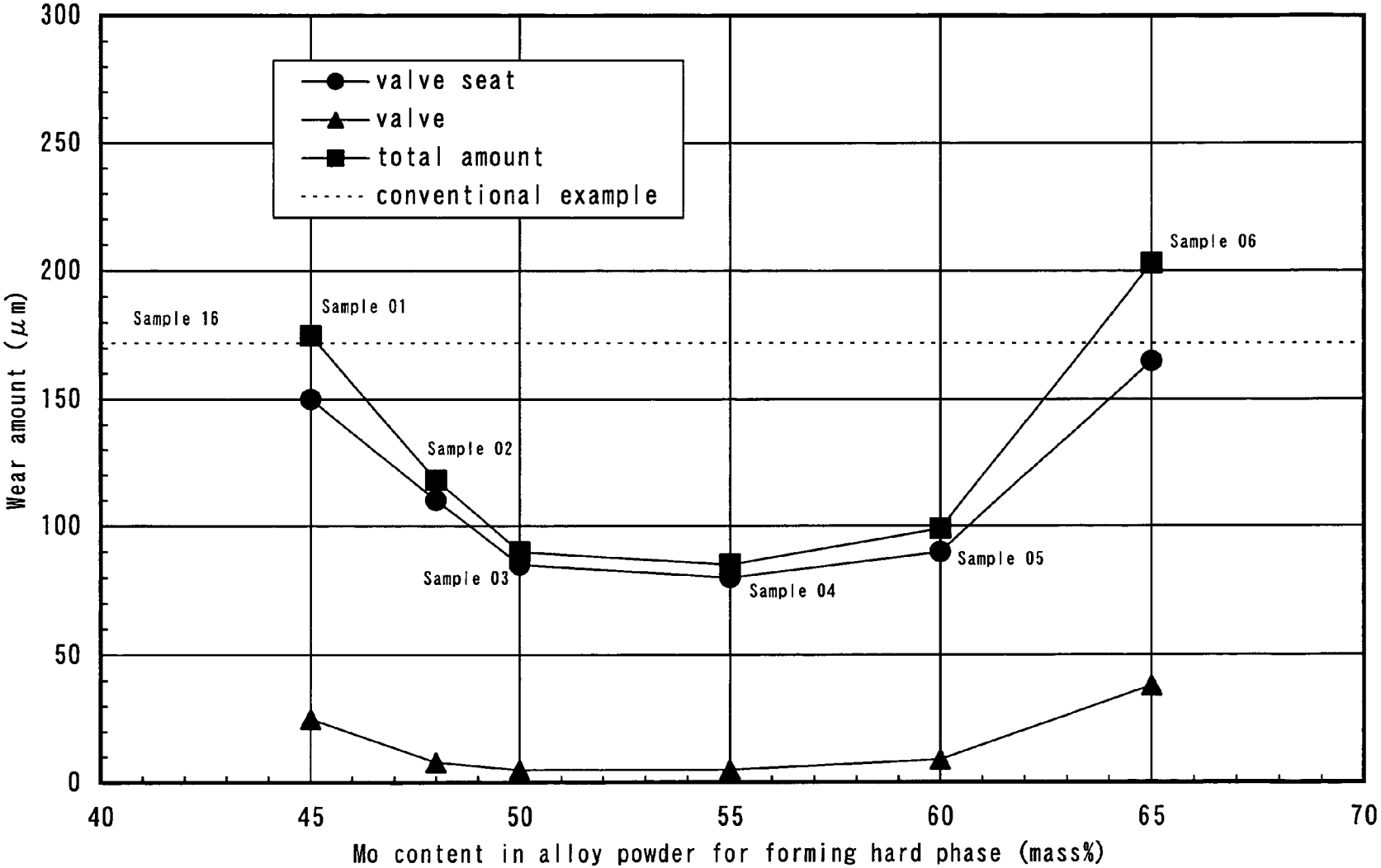
FIG. 5 is a graph of the relationship of wear and Mo amount in an alloy powder for forming a hard phase.
Figure 6:
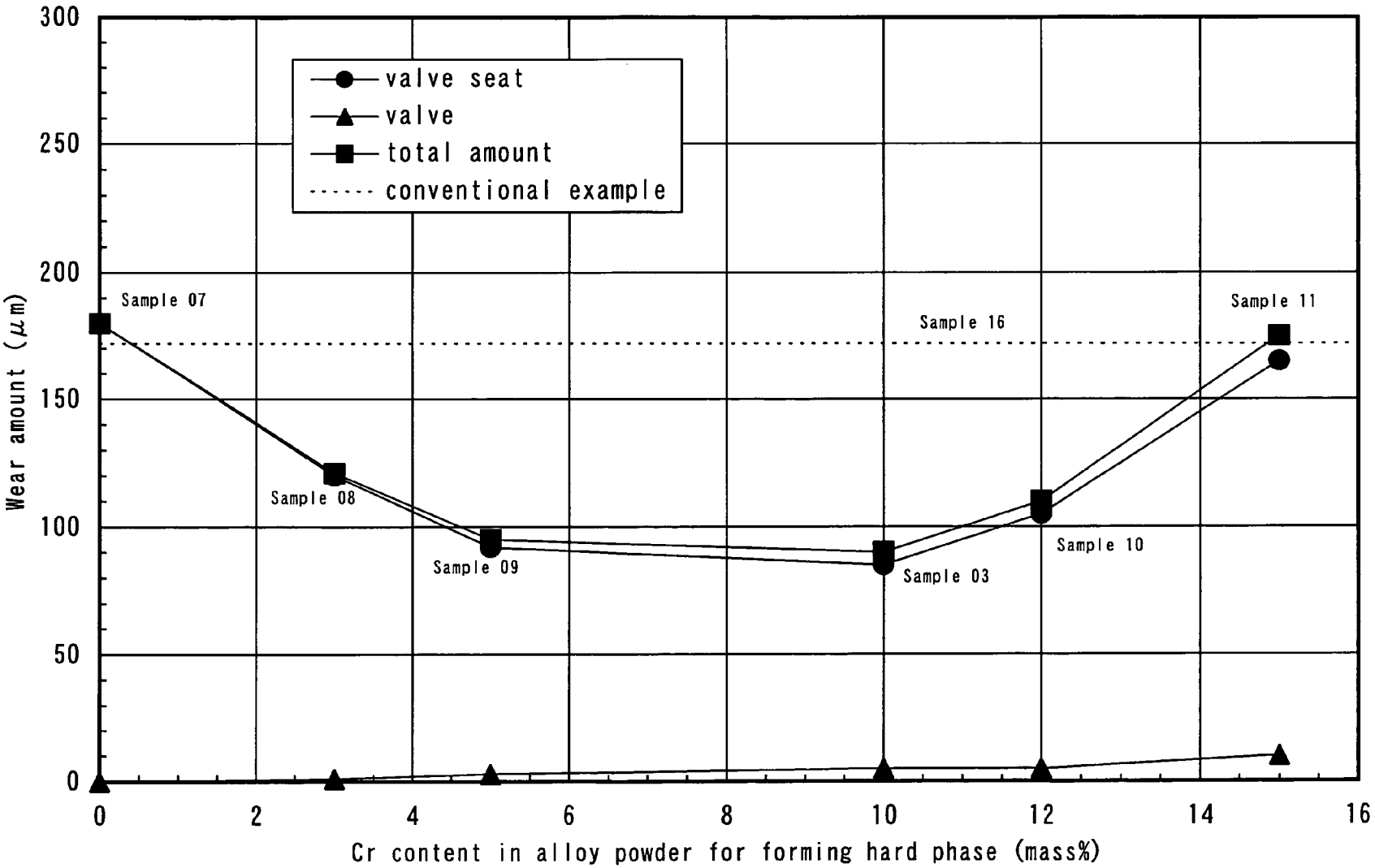
FIG. 6 is a graph of the relationship of wear and Cr amount in an alloy powder for forming a hard phase.
Figure 7:
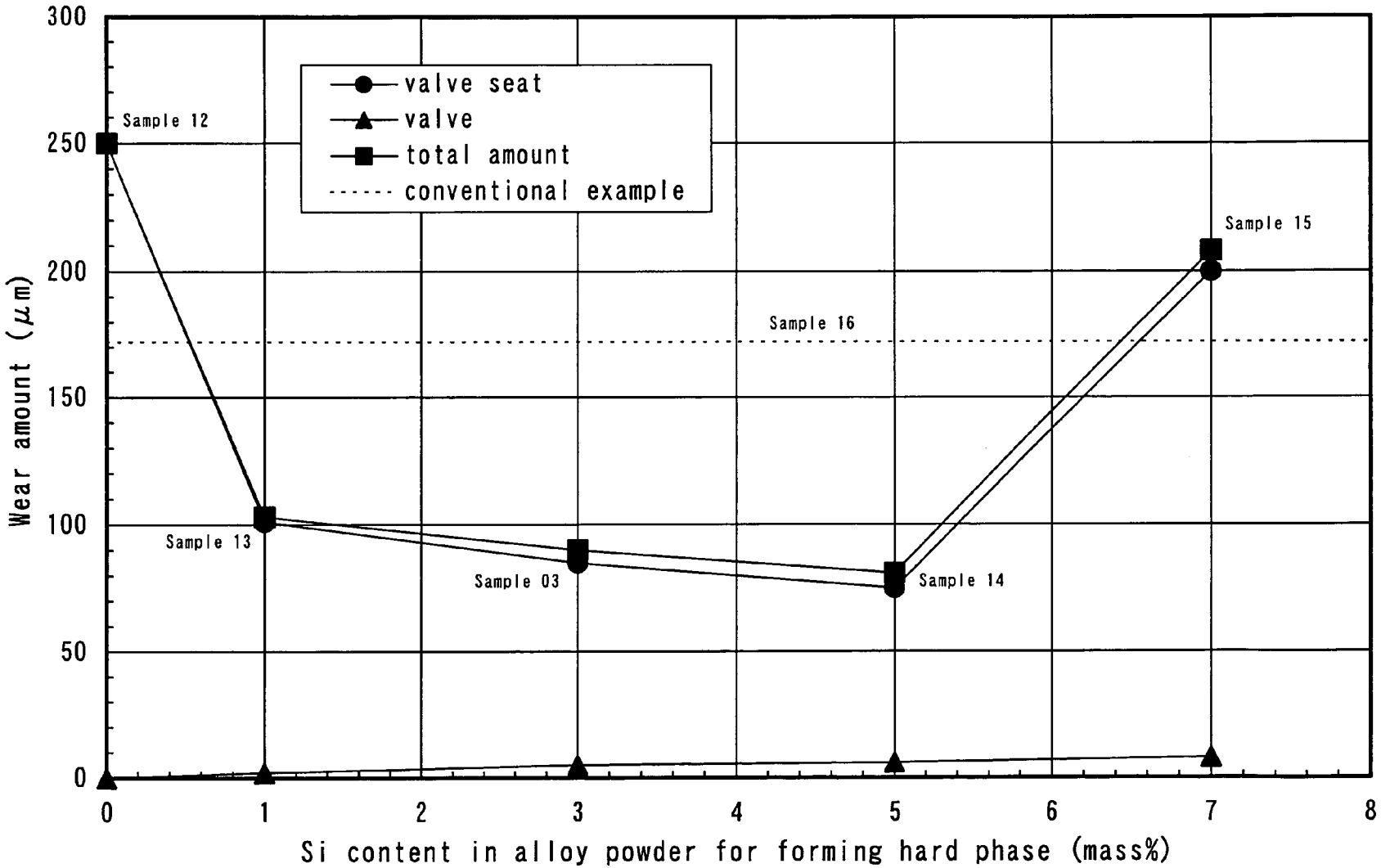
FIG. 7 is a graph of the relationship of wear and Si amount in an alloy powder for forming a hard phase.

Referring now to FIG. 5 to FIG. 7, test results are discussed. Dotted lines in FIG. 5 to FIG. 7 show the wear level (total wear of valve seat and valve) of sample 16 (prior art).

(Relationship Between Wear and Mo Amount in Alloy Powder for Forming Hard Phase)

As shown in FIG. 5, in sintered alloys (samples 02 to 05) in which Mo content in alloy powder for forming the hard phase is in a range of 48 to 60 mass %, the wear amount of valve seat and valve is stable and low, and a favorable wear resistance is exhibited. On the other hand, in sintered alloys (samples 01 and 06) in which the Mo content is out of the range of 48 to 60 mass %, in particular, the wear amount of valve seat is significantly high, and the wear amount of valve is also relatively high. It has been therefore confirmed that an excellent wear resistance is realized as long as the Mo content in alloy powder for forming hard phase is in a range of 48 to 60 mass %.

(Relationship between Wear and Cr Amount in Alloy Powder for Forming Hard Phase)

As shown in FIG. 6, in sintered alloys (samples 03 and 08 to 10) in which the Cr content in the alloy powder for forming the hard phase is in a range of 3 to 12 mass %, the wear amount of the valve seat and valve is stable and low, and a favorable wear resistance is exhibited. On the other hand, in sintered alloys (samples 07 and 11) in which the Cr content is out of the range of 3 to 12 mass %, in particular, the wear amount of the valve seat is significantly high. It has been therefore confirmed that an excellent wear resistance is realized as long as the Cr content in the alloy powder for forming the hard phase is in a range of 3 to 12 mass %.

(Relationship between Wear and Si Amount in Alloy Powder for Forming Hard Phase)

As shown in FIG. 7, in sintered alloys (samples 03, 13 and 14) in which the Si content in the alloy powder for forming the hard phase is in a range of 1 to 5 mass %, the wear amount of the valve seat and the valve is stable and low, and a favorable wear resistance is exhibited. On the other hand, in sintered alloys (samples 12 and 15) in which the Si content is out of the range of 1 to 5 mass %, in particular, the wear amount of the valve seat is significantly high. It has been therefore confirmed that an excellent wear resistance is realized as long as the Si content in the alloy powder for forming hard phase is in a range of 1 to 5 mass %.

Embodiment 2

Effects of Content of Alloy Powder for Forming Hard Phase

As the alloy powder for forming matrix, an alloy powder of Fe-6.5Co-1.5Mo—Ni disclosed in patent reference 2 was prepared, and the powder for forming hard phase used in sample 03 in embodiment 1 was and the alloy powder for forming hard phase added by the amount as in Table 2, and a ring of ϕ30 (mm)×ϕ20 (mm)×h10 (mm) was d under the same condition as in embodiment 1.

TABLE 2

| Sample | Content of alloy powder for forming | Wear amount, μm | | | |
|---|---|---|---|---|---|
| No. | hard phase, mass % | Valve seat | Valve | Total | Remarks |
| 17 | 0.0 | 263 | 0 | 263 | Out of scope of invention |
| 18 | 5.0 | 158 | 1 | 159 | |
| 19 | 15.0 | 110 | 2 | 112 | |
| 20 | 20.0 | 95 | 3 | 98 | |
| 03 | 25.0 | 85 | 5 | 90 | |
| 21 | 30.0 | 90 | 7 | 97 | |
| 22 | 40.0 | 108 | 17 | 125 | |
| 23 | 50.0 | 150 | 53 | 203 | Out of scope of invention |
| 16 | 25.0 | 149 | 23 | 172 | Prior art |

These formed bodies were sintered at 1180° C. for 60 minutes in decomposed ammonia gas atmosphere, and samples 17 to 23 were prepared. In these samples, simplified wear tests were conducted, and results are shown in Table 2 with the results of sample 03 and 16 in embodiment 1.

Figure 8:
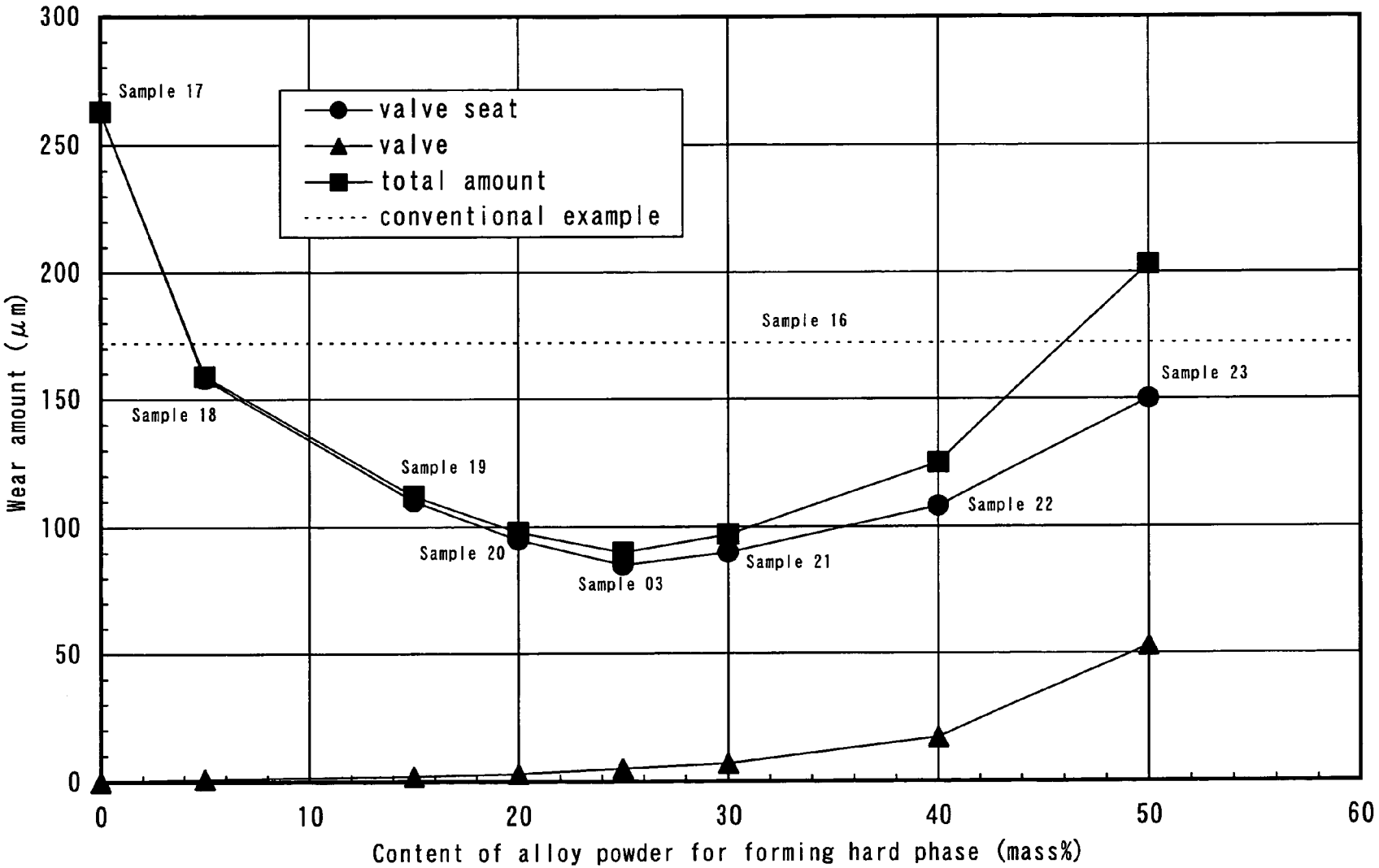
FIG. 8 is a graph of the relationship of wear and content of alloy powder for forming a hard phase.

Referring now to FIG. 8, test results are discussed. Dotted lines in FIG. 8 show the wear level (total wear of valve seat and valve) of sample 16 (prior art).

(Relationship between Wear and Content of Alloy Powder for Forming Hard Phase)

As shown in FIG. 8, in sintered alloys (samples 03 and 18 to 22) in which content of the alloy powder for forming the hard phase in the overall mass of mixed powder is in a range of 5 to 40 mass %, the wear amount of the valve seat and valve is stable and low, and a favorable wear resistance is exhibited. On the other hand, in sintered alloys (samples 17 and 23) in which content of alloy powder for forming hard phase is out of the range of 5 to 40 mass %, in particular, the wear amount of valve seat is significantly high. It has been therefore confirmed that an excellent wear resistance is realized as long as the content of alloy powder for forming the hard phase in the overall mass of mixed powder is in a range of 5 to 40 mass %.

Embodiment 3

Effects of Sintering Temperature

As the alloy powder for forming the matrix, an alloy powder of Fe-6.5Co-1.5Mo—Ni disclosed in patent reference 2 was prepared, and the alloy powder for forming the hard phase used in sample 03 in embodiment 1 was used, and the sintering temperature was set as shown in Table 3, and a ring of ϕ30 (mm)×ϕ20 (mm)×h10 (mm) was formed under the same condition as in embodiment 1.

TABLE 3

| Sample | Sintering temperature | Wear amount, μm | | | |
|---|---|---|---|---|---|
| No. | ° C. | Valve seat | Valve | Total | Remarks |
| 24 | 900 | 300 | 0 | 300 | Out of scope of invention |
| 25 | 1000 | 130 | 2 | 132 | |
| 26 | 1100 | 100 | 4 | 104 | |
| 03 | 1180 | 85 | 5 | 90 | |
| 27 | 1200 | 80 | 6 | 86 | |
| 28 | 1230 | 210 | 3 | 213 | Out of scope of invention |
| 16 | 1180 | 149 | 23 | 172 | Prior art |

These formed bodies were sintered for 60 minutes in an decomposed ammonia gas atmosphere, and samples 24 to 28 were prepared. In these samples, simplified wear tests were conducted, and the results are shown in Table 3 with the results of sample 03 and 16 in embodiment 1.

Figure 9:
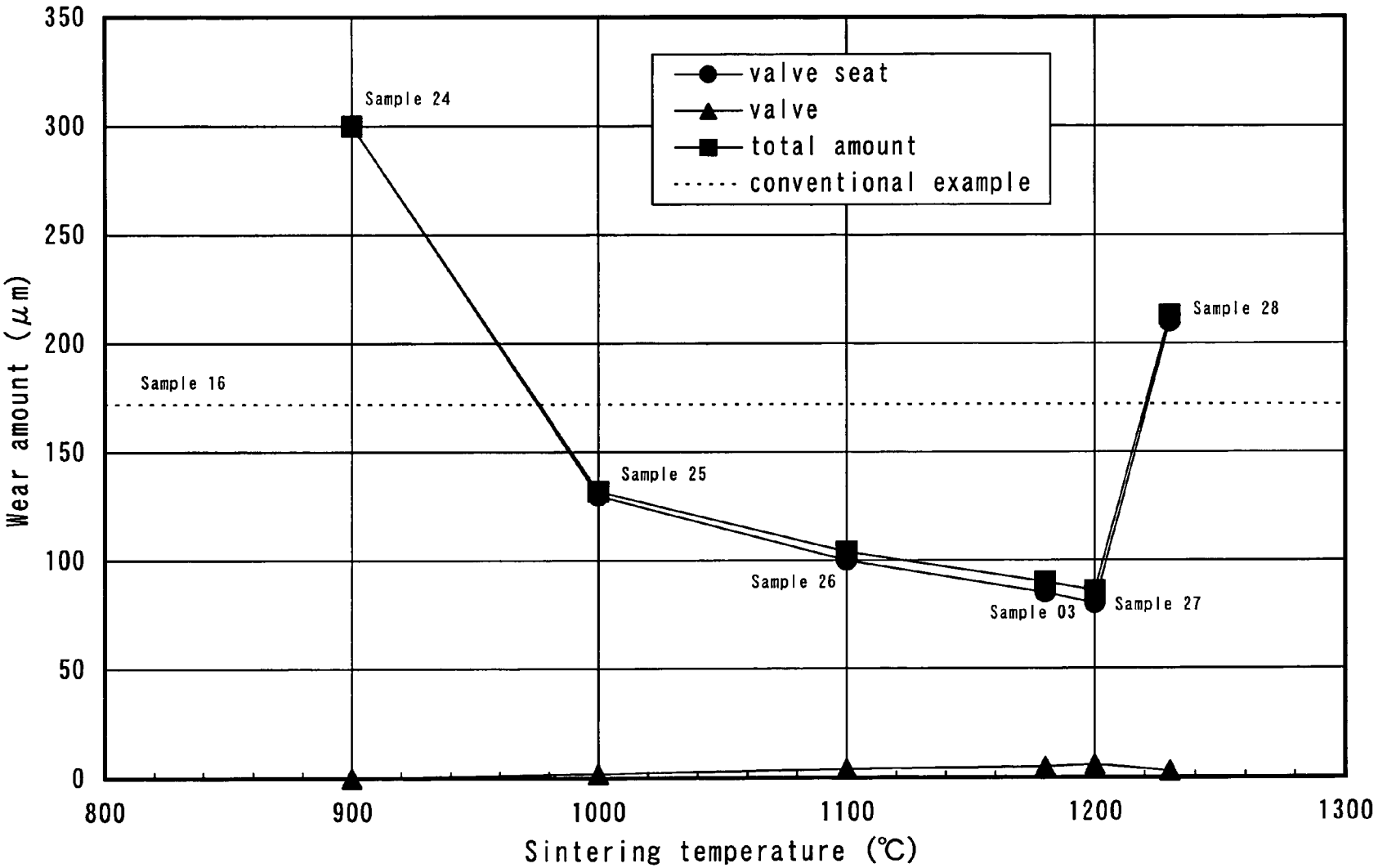
FIG. 9 is a graph of the relationship of wear and sintering temperature.

Referring now to FIG. 9, test results are discussed. Dotted lines in FIG. 9 show the wear level (total wear of valve seat and valve) of sample 16 (prior art).

(Relationship between Wear and Sintering Temperature)

As shown in FIG. 9, in sintered alloys (samples 03 and 25 to 27) in which the sintering temperature is in a range of 1000 to 1200° C., the wear amount of the valve seat and the valve is stable and low, and a favorable wear resistance is exhibited. On the other hand, in sintered alloys (samples 24 and 28) in which the sintering temperature is out of the range of 1000 to 1200° C., in particular, the wear amount of the valve seat is significantly high. It has been therefore confirmed that an excellent wear resistance is realized as long as the sintering temperature is in a range of 1000 to 1200° C.

Embodiment 4

Effects of Hard Phase

As the alloy powder for forming matrix, an alloy powder of Fe-3Cr-0.3Mo-0.3V disclosed in patent reference 1, and alloy powder of Fe-6.5Co-1.5Mo—Ni were prepared independently, or these alloy powders were mixed at a rate of 1:1, and a mixed powder was prepared. Further, as the alloy powder for forming the hard phase, Co-50Mo-10Cr-3Si alloy of the invention, and conventional Fe-3Cr-0.3Mo-0.3V alloy were prepared. By adding 25 mass % of alloy powder for forming the hard phase and 1.1 mass % of graphite powder were added to the powder for forming matrix in the composition shown in Table 4, and a ring of ϕ30 (mm)×ϕ20 (mm)×h10 (mm) was formed under the same condition as in embodiment 1.

TABLE 4

| Sample | Alloy powder for forming hard | Ratio of powder for forming matrix | | Wear amount, μm | | | |
|---|---|---|---|---|---|---|---|
| No | phase | Fe—6.5Co—1.5Mo—1.5Ni | Fe—3Cr—0.3Mo—0.3v | Valve seat | Valve | Total | Remarks |
| 03 | Co—50Mo—10Cr—3Si | 100 | | 85 | 5 | 90 | |
| 29 | Co—50Mo—10Cr—3Si | | 100 | 120 | 5 | 125 | |
| 30 | Co—50Mo—10Cr—3Si | 50 | 50 | 108 | 5 | 113 | |
| 16 | Co—28Mo—8Cr—2.5Si | 100 | | 149 | 23 | 172 | Prior art |
| 31 | Co—28Mo—8Cr—2.5Si | | 100 | 183 | 25 | 208 | Prior art |
| 32 | Co—28Mo—8Cr—2.5Si | 50 | 50 | 174 | 25 | 199 | Prior art |

These formed bodies were sintered at 1180° C. for 60 minutes in an decomposed ammonia gas atmosphere, and samples 29 to 32 were prepared. In these samples, simplified wear tests were conducted, and results are shown in Table 4 with the results of sample 03 and 16 in embodiment 1.

Figure 10:
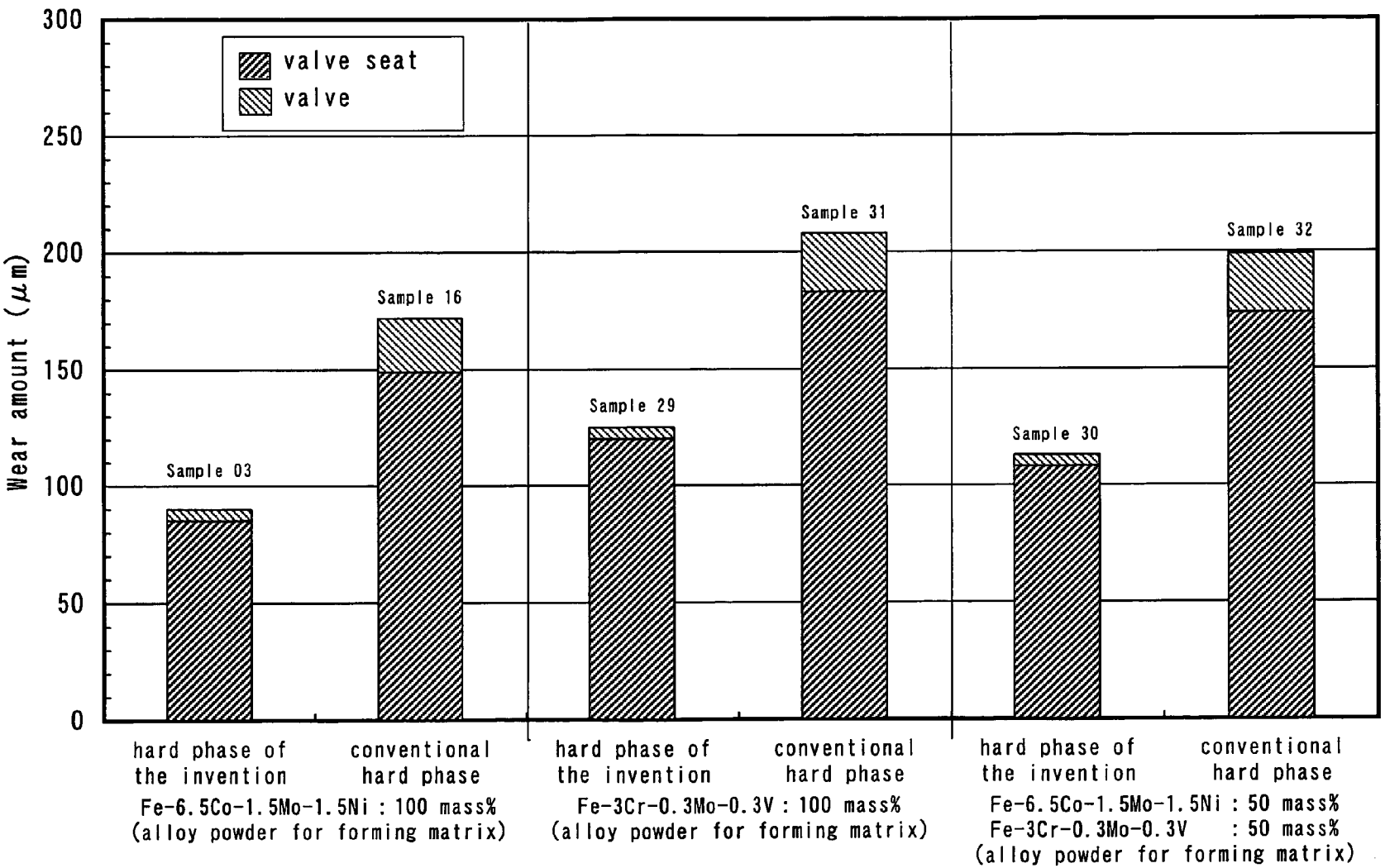
FIG. 10 is a graph of the relationship of wear and hard phase.

Referring now to FIG. 10, test results are discussed.

(Relationship between Wear and Hard Phase)

As shown in FIG. 10, when the alloy powder for forming the hard phase of the invention is used (samples 03, 29 and 30), regardless of the type of alloy powder for forming the matrix, the wear amount of the valve seat and the valve is stable and low, as compared with the case of using the conventional alloy powder for forming the hard phase (samples 16, 31 and 32), and a favorable wear resistance is exhibited. It has been therefore confirmed that an excellent wear resistance is realized by using the alloy powder for forming the hard phase of the invention.

Embodiment 5

Effects of Composition and Content of Alloy Powder for Forming Co Base Hard Phase (Alloy Powder B)

Alloy powder A for forming the matrix, alloy powder B for forming the Co base hard phase, alloy powder C for forming the Fe base hard phase, and graphite powder shown in Table 5 were blended at the rate specified in Table 5, together with forming lubricant (0.8 mass % of zinc stearate), and the mixed powder was formed in a ring of ϕ30 (mm)×ϕ20 (mm)×h10 (mm) at a forming pressure of 650 MPa.

TABLE 5

| Sample No. | Blending ratio, mass % | | | | | | | | Sintering temperature ° C. |
|---|---|---|---|---|---|---|---|---|---|
| | Alloy powder A | Alloy powder B | | | | | Alloy powder C | Graphite powder | |
| | | Composition, mass % | | | | | | | |
| | Fe—5Mo | Co | Mo | Si | Cr | Fe—5Mo—2V—6W—4Cr—1C | | | |
| 41 | Balance | 25.00 Balance | 45.00 | 3.00 | 10.00 | | 20.00 | 0.70 | 1180 |
| 42 | Balance | 25.00 Balance | 48.00 | 3.00 | 10.00 | | 20.00 | 0.70 | 1180 |
| 43 | Balance | 25.00 Balance | 50.00 | 3.00 | 10.00 | | 20.00 | 0.70 | 1180 |
| 44 | Balance | 25.00 Balance | 55.00 | 3.00 | 10.00 | | 20.00 | 0.70 | 1180 |
| 45 | Balance | 25.00 Balance | 60.00 | 3.00 | 10.00 | | 20.00 | 0.70 | 1180 |
| 46 | Balance | 25.00 Balance | 65.00 | 3.00 | 10.00 | | 20.00 | 0.70 | 1180 |
| 47 | Balance | 25.00 Balance | 50.00 | 0.50 | 10.00 | | 20.00 | 0.70 | 1180 |
| 48 | Balance | 25.00 Balance | 50.00 | 1.00 | 10.00 | | 20.00 | 0.70 | 1180 |
| 49 | Balance | 25.00 Balance | 50.00 | 5.00 | 10.00 | | 20.00 | 0.70 | 1180 |
| 50 | Balance | 25.00 Balance | 50.00 | 7.00 | 10.00 | | 20.00 | 0.70 | 1180 |
| 51 | Balance | 25.00 Balance | 50.00 | 3.00 | — | | 20.00 | 0.70 | 1180 |
| 52 | Balance | 25.00 Balance | 50.00 | 3.00 | 3.00 | | 20.00 | 0.70 | 1180 |
| 53 | Balance | 25.00 Balance | 50.00 | 3.00 | 5.00 | | 20.00 | 0.70 | 1180 |
| 54 | Balance | 25.00 Balance | 50.00 | 3.00 | 12.00 | | 20.00 | 0.70 | 1180 |
| 55 | Balance | 25.00 Balance | 50.00 | 3.00 | 15.00 | | 20.00 | 0.70 | 1180 |
| 56 | Balance | — Balance | 50.00 | 3.00 | 10.00 | | 20.00 | 0.70 | 1180 |
| 57 | Balance | 5.00 Balance | 50.00 | 3.00 | 10.00 | | 20.00 | 0.70 | 1180 |
| 58 | Balance | 15.00 Balance | 50.00 | 3.00 | 10.00 | | 20.00 | 0.70 | 1180 |
| 59 | Balance | 40.00 Balance | 50.00 | 3.00 | 10.00 | | 20.00 | 0.70 | 1180 |
| 60 | Balance | 50.00 Balance | 50.00 | 3.00 | 10.00 | | 20.00 | 0.70 | 1180 |

These formed bodies were sintered at 1180° C. for 60 minutes in an decomposed ammonia gas atmosphere, and samples 41 to 60 were prepared. In these samples, simplified wear tests were conducted, and results are shown in Table 6.

TABLE 6

| Sample No. | Overall composition, mass % | | | | | | | | Wear amount, μm | | |
|---|---|---|---|---|---|---|---|---|---|---|---|
| | Fe | Mo | Co | Si | Cr | V | W | C | Valve seat | Valve | Total |
| 41 | Balance | 14.97 | 10.50 | 0.75 | 3.30 | 0.40 | 1.20 | 0.90 | 100 | 19 | 119 |
| 42 | Balance | 15.72 | 9.75 | 0.75 | 3.30 | 0.40 | 1.20 | 0.90 | 68 | 5 | 73 |
| 43 | Balance | 16.22 | 9.25 | 0.75 | 3.30 | 0.40 | 1.20 | 0.90 | 55 | 3 | 58 |
| 44 | Balance | 17.47 | 8.00 | 0.75 | 3.30 | 0.40 | 1.20 | 0.90 | 51 | 3 | 54 |
| 45 | Balance | 18.72 | 6.75 | 0.75 | 3.30 | 0.40 | 1.20 | 0.90 | 60 | 5 | 65 |
| 46 | Balance | 19.97 | 5.50 | 0.75 | 3.30 | 0.40 | 1.20 | 0.90 | 130 | 28 | 158 |
| 47 | Balance | 16.22 | 9.88 | 0.13 | 3.30 | 0.40 | 1.20 | 0.90 | 200 | 0 | 200 |
| 48 | Balance | 16.22 | 9.75 | 0.25 | 3.30 | 0.40 | 1.20 | 0.90 | 86 | 0 | 86 |
| 49 | Balance | 16.22 | 8.75 | 1.25 | 3.30 | 0.40 | 1.20 | 0.90 | 50 | 3 | 53 |
| 50 | Balance | 16.22 | 8.25 | 1.75 | 3.30 | 0.40 | 1.20 | 0.90 | 150 | 5 | 155 |
| 51 | Balance | 16.22 | 11.75 | 0.75 | 0.80 | 0.40 | 1.20 | 0.90 | 150 | 0 | 150 |
| 52 | Balance | 16.22 | 11.00 | 0.75 | 1.55 | 0.40 | 1.20 | 0.90 | 95 | 1 | 96 |
| 53 | Balance | 16.22 | 10.50 | 0.75 | 2.05 | 0.40 | 1.20 | 0.90 | 60 | 3 | 63 |
| 54 | Balance | 16.22 | 8.75 | 0.75 | 3.80 | 0.40 | 1.20 | 0.90 | 75 | 3 | 78 |
| 55 | Balance | 16.22 | 8.00 | 0.75 | 4.55 | 0.40 | 1.20 | 0.90 | 150 | 5 | 155 |
| 56 | Balance | 4.97 | — | — | 0.80 | 0.40 | 1.20 | 0.90 | 320 | 0 | 320 |
| 57 | Balance | 7.22 | 1.85 | 0.15 | 1.30 | 0.40 | 1.20 | 0.90 | 86 | 2 | 88 |
| 58 | Balance | 11.72 | 5.55 | 0.45 | 2.30 | 0.40 | 1.20 | 0.90 | 74 | 2 | 76 |
| 59 | Balance | 22.97 | 14.80 | 1.20 | 4.80 | 0.40 | 1.20 | 0.90 | 78 | 8 | 86 |
| 60 | Balance | 27.47 | 18.50 | 1.50 | 5.80 | 0.40 | 1.20 | 0.90 | 120 | 52 | 172 |

The simplified wear tests were conducted in the loaded state of striking and sliding at high temperature. More specifically, the ring test piece was processed into a valve seat shape having a slope of 45 degrees at the inner side, and the sintered alloy was press-fitted into an aluminum alloy housing. On an outer surface made of SUH-36 material, a circular contacting member (valve) having a slope of 45 degrees in part was driven by motor, and vertical position motions were caused by rotation of eccentric cam, and slope sides of the sintered alloy and contacting member were repeatedly contacted. That is, valve motions are repeated actions of releasing motion of departing from the valve seat by the eccentric cam rotated by motor driving, and contacting motion on the valve seat by the valve spring, and vertical piston motions are realized. In this test, the contacting member was heated by a burner and the temperature was set to the sintered alloy temperature of 300° C., and striking operations of simplified wear test were 2800 times/minute, and the duration of repetition was 15 hours. In this manner, the wear of the valve seats and wear of the valves after testing were measured and evaluated.

Referring now to FIG. 11 to FIG. 14, test results are discussed.

(Relationship between Wear and Mo Amount in Alloy Powder B)

Figure 11:
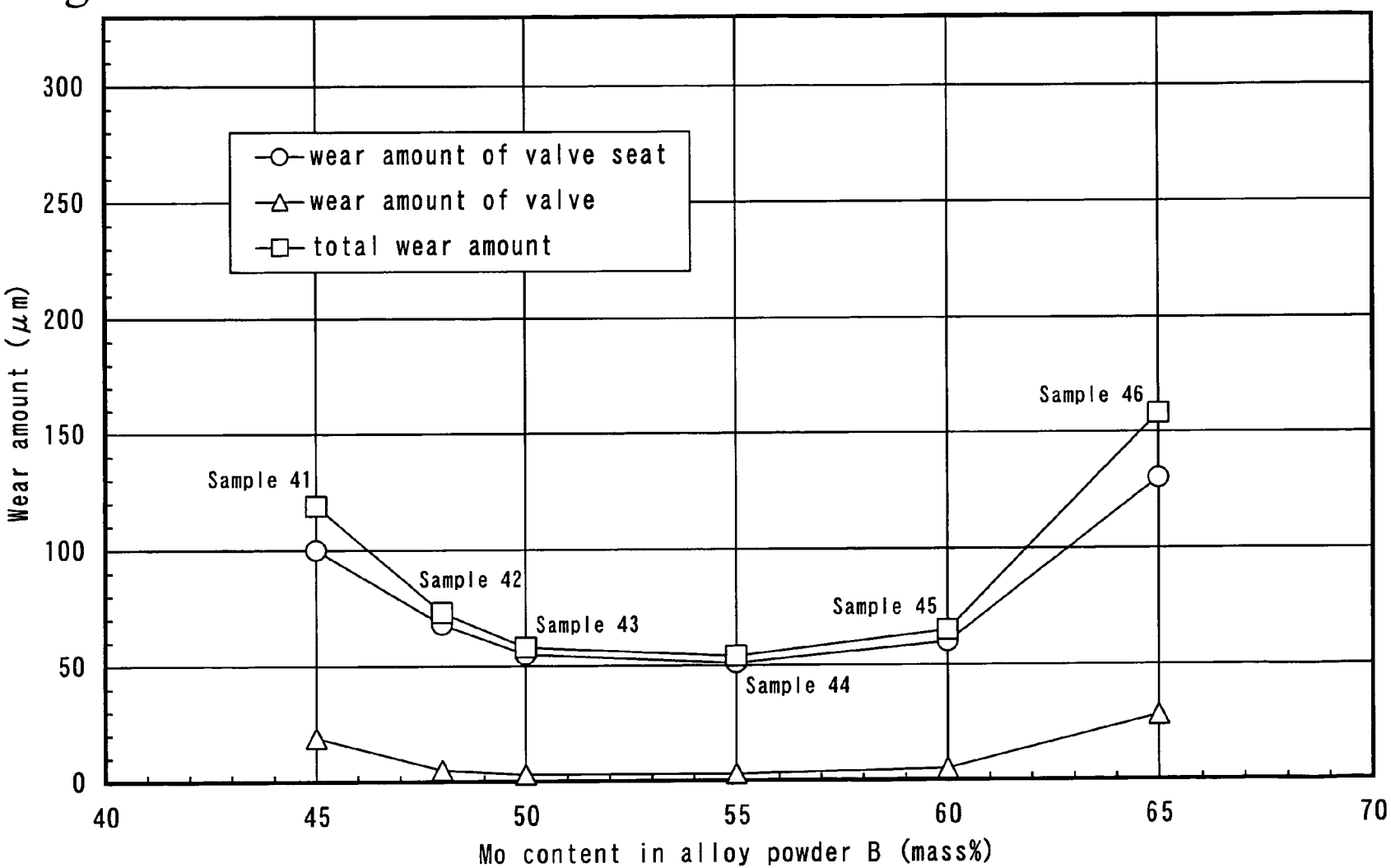
FIG. 11 is a graph of the relationship of wear and Mo amount in alloy powder B.

As shown in FIG. 11, in sintered alloys (samples 42 to 45) in which Mo content in alloy B is in a range of 48 to 60 mass %, the wear amounts of the valve seats and the valves are stable and low, and a favorable wear resistance is exhibited. On the other hand, in sintered alloys (samples 41 and 46) in which the Mo content is out of the range of 48 to 60 mass %, in particular, the wear amount of the valve seat is significantly high, and the wear amount of valve is also high relatively. It has been therefore confirmed that an excellent wear resistance is realized as long as the Mo content in the alloy powder B is in a range of 48 to 60 mass %.

(Relationship between Wear and Si Amount in Alloy Powder B)

Figure 12:
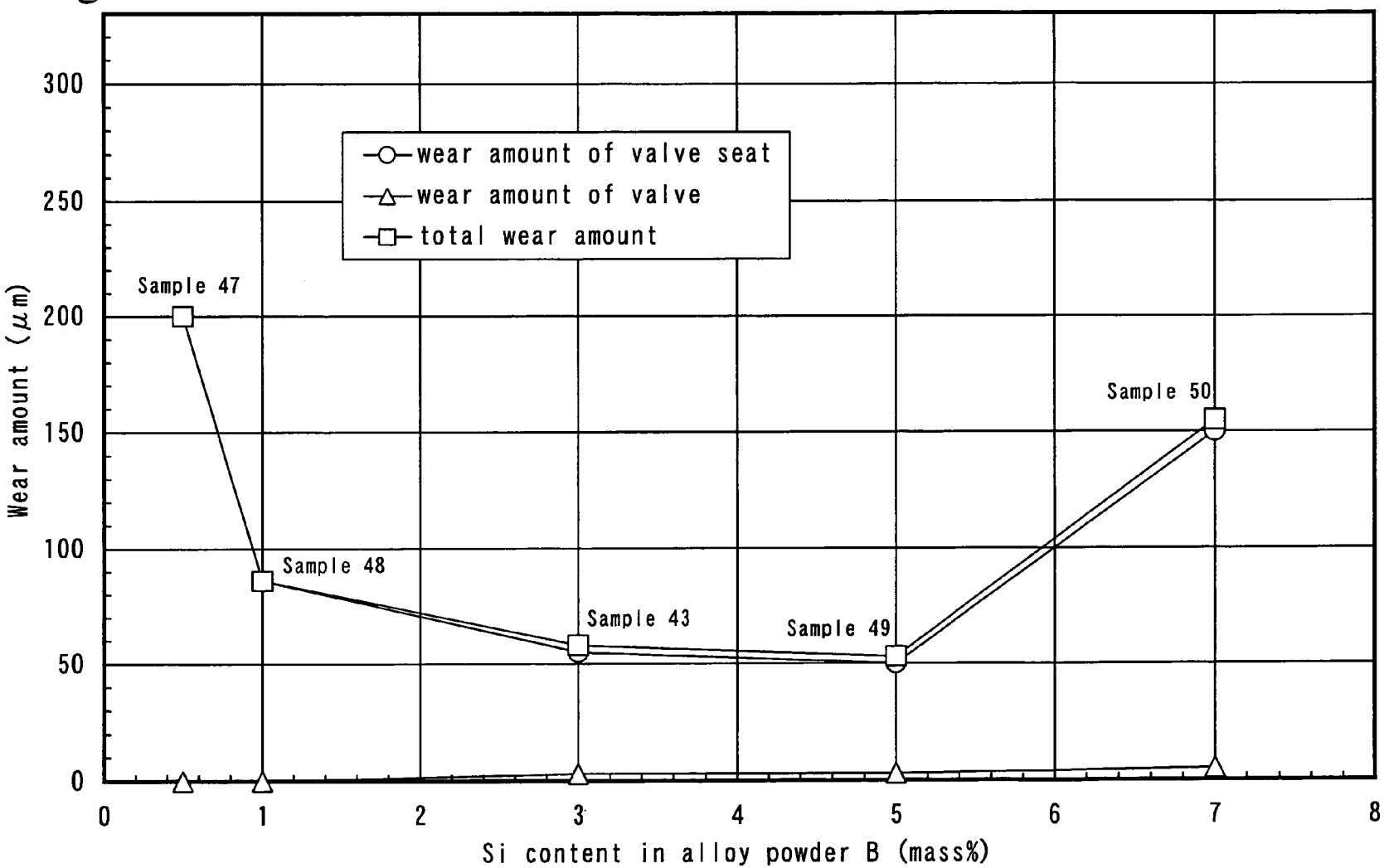
FIG. 12 is a graph of the relationship of wear and Si amount in alloy powder B.

As shown in FIG. 12, in sintered alloys (samples 43, 48 and 49) in which the Si content in the alloy powder B is in a range of 1 to 5 mass %, the wear amounts of the valve seats and the valves are stable and low, and a favorable wear resistance is exhibited. On the other hand, in sintered alloys (samples 47 and 50) in which the Si content is out of the range of 1 to 5 mass %, in particular, the wear amount of the valve seat is significantly high. It has been therefore confirmed that an excellent wear resistance is realized as long as the Si content in alloy powder B is in a range of 1 to 5 mass %.

(Relationship between Wear and Cr Amount in Alloy Powder B)

Figure 13:
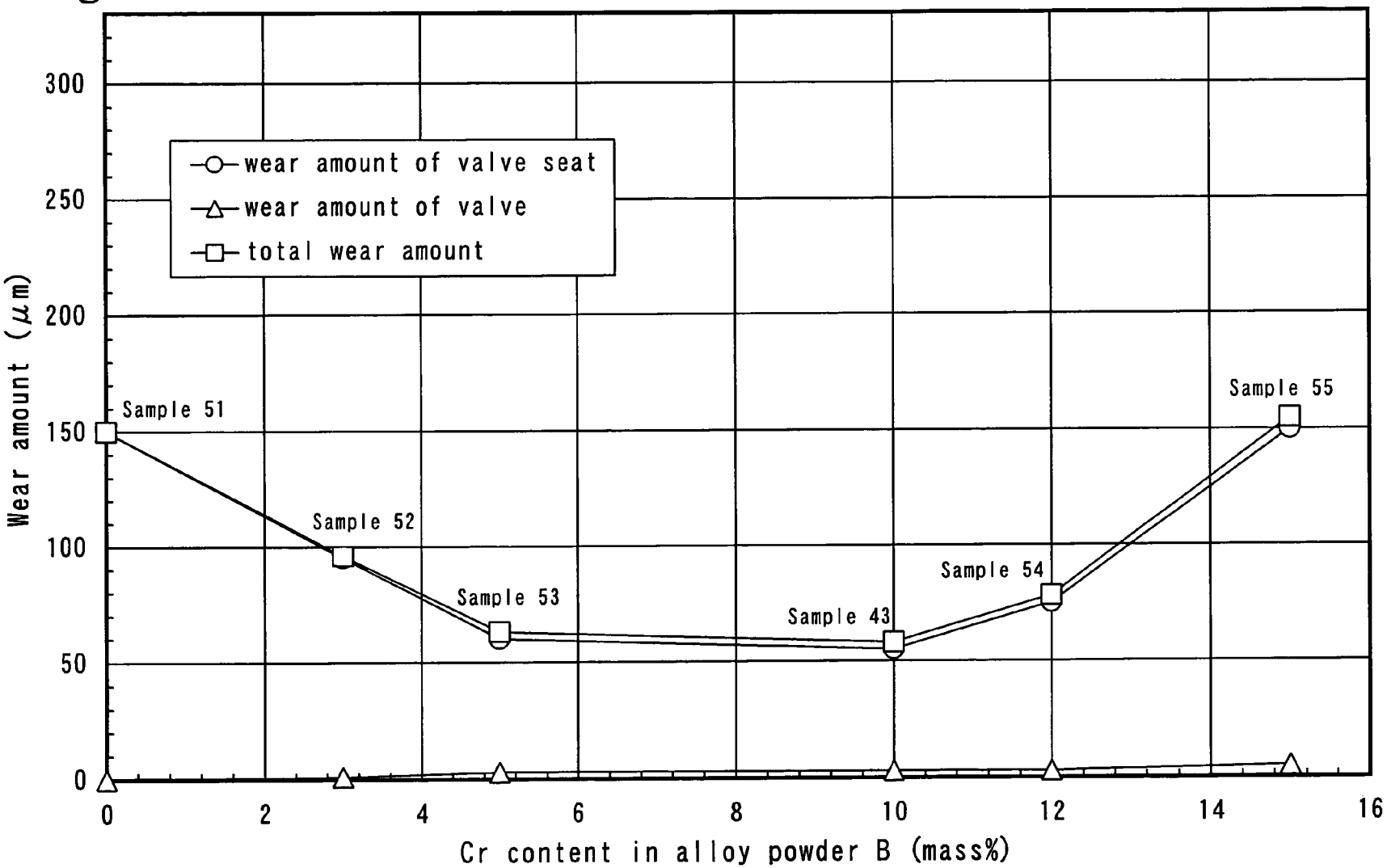
FIG. 13 is a graph of the relationship of wear and Cr amount in alloy powder B.

As shown in FIG. 13, in sintered alloys (samples 43 and 52 to 54) in which the Cr content in the alloy powder B is in a range of 3 to 12 mass %, the wear amounts of the valve seat and the valves are stable and low, and a favorable wear resistance is exhibited. On the other hand, in sintered alloys (samples 51 and 55) in which the Cr content is out of the range of 3 to 12 mass %, in particular, the wear amounts of valve seats are significantly high. It has been therefore confirmed that an excellent wear resistance is realized as long as the Cr content in the alloy powder B is in a range of 3 to 12 mass %.

(Relationship between Wear and Content of Alloy Powder B)

Figure 14:
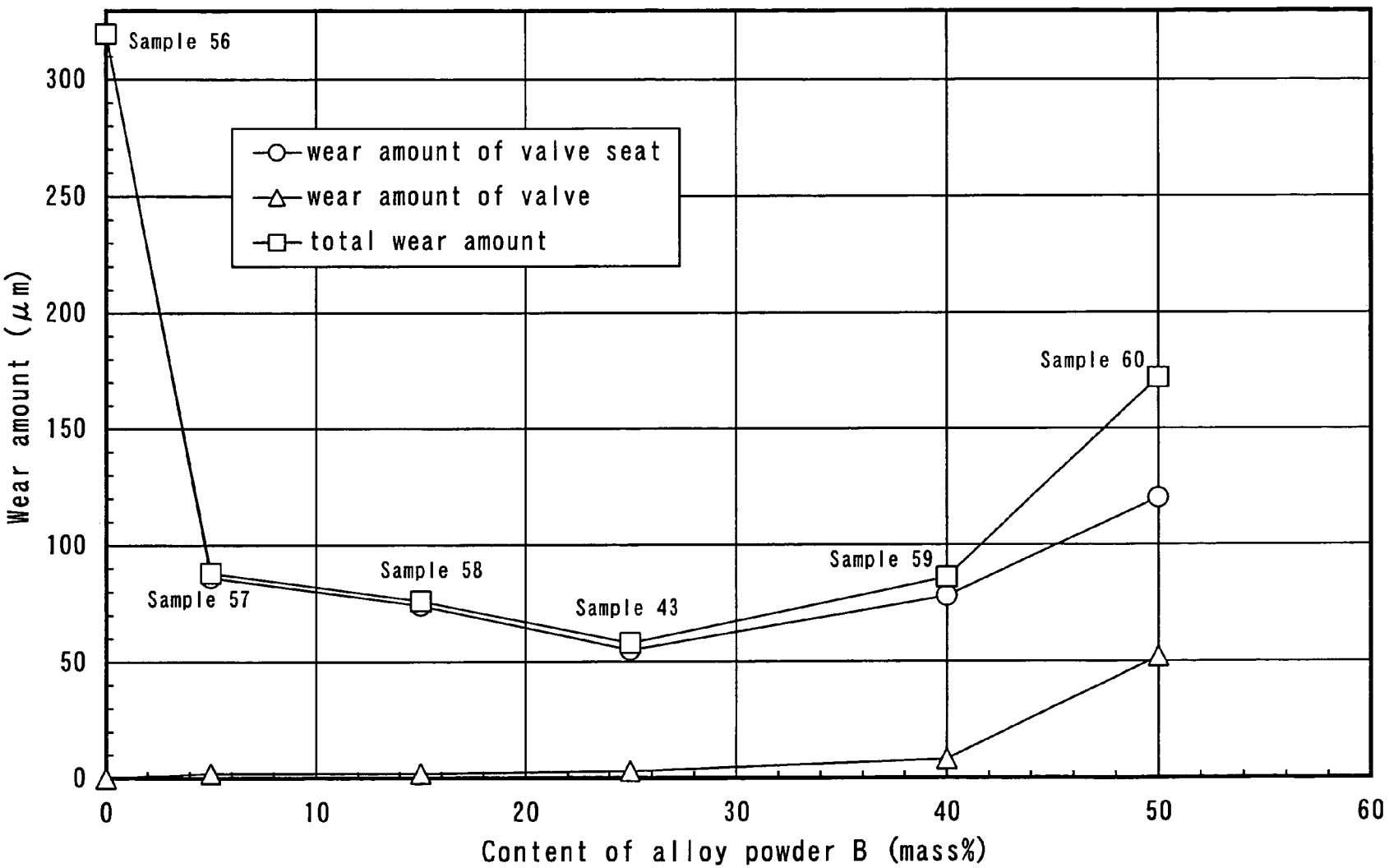
FIG. 14 is a graph of the relationship of wear and content alloy powder B.

As shown in FIG. 14, in sintered alloys (samples 43 and 57 to 59) in which the content of alloy powder B in the overall mass of mixed powder is in a range of 5 to 40 mass %, the wear amounts of the valve seats and valves are stable and low, and a favorable wear resistance is exhibited. On the other hand, in sintered alloys (samples 56 and 60) in which the content of the alloy powder B is out of the range of 5 to 40 mass %, in particular, the wear amounts of the valve seats are significantly high. It has been therefore confirmed that an excellent wear resistance is realized as long as the content of alloy powder B in the overall mass of mixed powder is in a range of 5 to 40 mass %.

Embodiment 6

Effects of Composition and Content of Alloy Powder for Forming Matrix (Alloy Powder A)

Alloy powder A for forming the matrix, alloy powder B for forming the Co base hard phase, alloy powder C for forming the Fe base hard phase, aphite powder shown in Table 7 were blended at the rates specified in Table 7, together with forming lubricant (0.8 mass % of zinc stearate), and the mixed powder was formed in a ring of ϕ30 (mm)×ϕ20 (mm)×h10 (mm) at forming pressure of 650 MPa. These formed bodies were sintered under the same condition as in embodiment 5, and samples 43 and 61 to 64 in the composition as shown in Table 8 were prepared. In these samples, simplified wear tests were conducted as in embodiment 5, and the results are shown in 8.

TABLE 7

| Sample | Blending ratio, mass % | | | | | | |
|---|---|---|---|---|---|---|---|
| | Alloy powder A | | | | | | |
| | | Composition, mass % | | Alloy powder B | Alloy powder C | Graphite | Sintering temperature |
| No. | | Fe | Mo | Co—50Mo—3Si—10Cr | Fe—5Mo—2V—6W—4Cr—1C | powder | ° C. |
| 61 | Balance | Balance | — | 25.00 | 20.00 | 0.70 | 1180 |
| 62 | Balance | Balance | 3.00 | 25.00 | 20.00 | 0.70 | 1180 |
| 43 | Balance | Balance | 5.00 | 25.00 | 20.00 | 0.70 | 1180 |
| 63 | Balance | Balance | 7.00 | 25.00 | 20.00 | 0.70 | 1180 |
| 64 | Balance | Balance | 10.00 | 25.00 | 20.00 | 0.70 | 1180 |

TABLE 8

| Sample | Overall composition, mass % | | | | | | | | Wear amount, μm | | |
|---|---|---|---|---|---|---|---|---|---|---|---|
| No. | Fe | Mo | Co | Si | Cr | V | W | C | Valve seat | Valve | Total |
| 61 | Balance | 13.50 | 9.25 | 0.75 | 3.30 | 0.40 | 1.20 | 0.90 | 180 | 0 | 180 |
| 62 | Balance | 15.13 | 9.25 | 0.75 | 3.30 | 0.40 | 1.20 | 0.90 | 78 | 2 | 80 |
| 43 | Balance | 16.22 | 9.25 | 0.75 | 3.30 | 0.40 | 1.20 | 0.90 | 55 | 3 | 58 |
| 63 | Balance | 17.30 | 9.25 | 0.75 | 3.30 | 0.40 | 1.20 | 0.90 | 60 | 5 | 65 |
| 64 | Balance | 18.93 | 9.25 | 0.75 | 3.30 | 0.40 | 1.20 | 0.90 | 150 | 4 | 154 |

Figure 15:
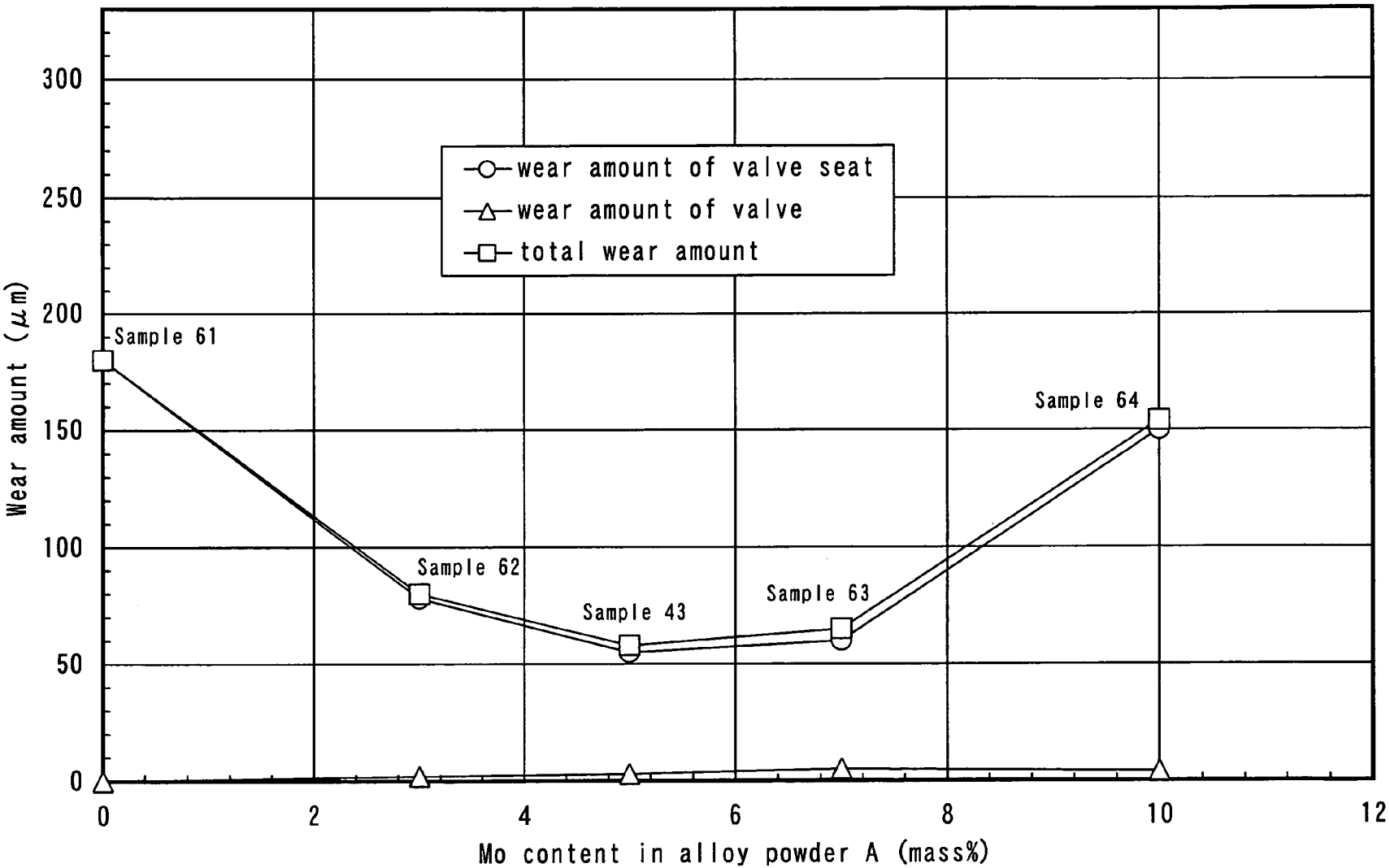
FIG. 15 is a graph of the relationship of wear and Mo amount in alloy powder A.

Referring now to FIG. 15, test results are discussed.

(Relationship between Wear and Mo Amount in Alloy Powder A)

As shown in FIG. 15, in sintered alloys (samples 43, 62 and 63) in the Mo content in alloy powder A is in a range of 3 to 7 mass %, the mounts of valve seats and valves are stable and low, and a favorable resistance is exhibited. On the other hand, in sintered alloys (samples 61 and 64) in which the Mo content is out of the range of 3 to 7 mass %, in particular, the wear amounts of the valve seats are significantly high. It has been therefore confirmed that an excellent wear resistance is realized as long as the Mo content in alloy powder A is in a range of 3 to 7 mass %.

Embodiment 7

Effects of Composition and Content of Alloy Powder for Forming Fe Base Hard Phase (Alloy Powder C)

Alloy powder A for forming the matrix, alloy powder B for forming the Co base hard phase, alloy powder C for forming the Fe base hard phase, and graphite powder shown in Table 9 were blended at the rates specified in Table 7, together with forming lubricant (0.8 mass % of zinc stearate), and the mixed powder was formed in a ring of ϕ30 (mm)×ϕ20 (mm)×h10 (mm) at a forming pressure of 650 MPa. These formed bodies were sintered under the same conditions as in embodiment 5, and samples 03 and 25 to 43 in the composition as shown in Table 10 were prepared. In these samples, simplified wear tests were conducted as in embodiment 5, and the results are shown in Table 10.

TABLE 9

| Sample No. | Blending ratio, mass % | | | | | | | | | | Sintering temperature ° C. |
|---|---|---|---|---|---|---|---|---|---|---|---|
| | Alloy powder A | Alloy powder B | Alloy powder C | | | | | | | Graphite powder | |
| | | | | Composition, mass % | | | | | | | |
| | Fe—5Mo | Co—50Mo—3Si—10Cr | Fe | Mo | V | W | Cr | C | | | |
| 65 | Balance | 25.00 | 20.00 Balance | | 2.00 | 6.00 | 4.00 | 1.00 | | 0.70 | 1180 |
| 66 | Balance | 25.00 | 20.00 Balance | 4.00 | 5.00 | 6.00 | 4.00 | 1.00 | | 0.70 | 1180 |
| 43 | Balance | 25.00 | 20.00 Balance | 5.00 | 2.00 | 6.00 | 4.00 | 1.00 | | 0.70 | 1180 |
| 67 | Balance | 25.00 | 20.00 Balance | 8.00 | 5.00 | 6.00 | 4.00 | 1.00 | | 0.70 | 1180 |
| 68 | Balance | 25.00 | 20.00 Balance | 10.00 | 2.00 | 6.00 | 4.00 | 1.00 | | 0.70 | 1180 |
| 69 | Balance | 25.00 | 20.00 Balance | 5.00 | — | — | — | 1.00 | | 0.70 | 1180 |
| 70 | Balance | 25.00 | 20.00 Balance | 5.00 | 0.50 | 4.00 | 2.00 | 1.00 | | 0.70 | 1180 |
| 71 | Balance | 25.00 | 20.00 Balance | 5.00 | 3.00 | 8.00 | 6.00 | 1.00 | | 0.70 | 1180 |
| 72 | Balance | 25.00 | 20.00 Balance | 5.00 | 4.00 | 10.00 | 7.00 | 1.00 | | 0.70 | 1180 |
| 73 | Balance | 25.00 | 20.00 Balance | 5.00 | 2.00 | 6.00 | 4.00 | 0.40 | | 0.70 | 1180 |
| 74 | Balance | 25.00 | 20.00 Balance | 5.00 | 2.00 | 6.00 | 4.00 | 0.60 | | 0.70 | 1180 |
| 75 | Balance | 25.00 | 20.00 Balance | 5.00 | 2.00 | 6.00 | 4.00 | 1.20 | | 0.70 | 1180 |
| 76 | Balance | 25.00 | 20.00 Balance | 5.00 | 2.00 | 6.00 | 4.00 | 1.60 | | 0.70 | 1180 |
| 77 | Balance | 25.00 | — Balance | 5.00 | 2.00 | 6.00 | 4.00 | 1.00 | | 0.70 | 1180 |
| 78 | Balance | 25.00 | 5.00 Balance | 5.00 | 2.00 | 6.00 | 4.00 | 1.00 | | 0.70 | 1180 |
| 79 | Balance | 25.00 | 10.00 Balance | 5.00 | 2.00 | 6.00 | 4.00 | 1.00 | | 0.70 | 1180 |
| 80 | Balance | 25.00 | 15.00 Balance | 5.00 | 2.00 | 6.00 | 4.00 | 1.00 | | 0.70 | 1180 |
| 81 | Balance | 25.00 | 25.00 Balance | 5.00 | 2.00 | 6.00 | 4.00 | 1.00 | | 0.70 | 1180 |
| 82 | Balance | 25.00 | 30.00 Balance | 5.00 | 2.00 | 6.00 | 4.00 | 1.00 | | 0.70 | 1180 |
| 83 | Balance | 25.00 | 35.00 Balance | 5.00 | 2.00 | 6.00 | 4.00 | 1.00 | | 0.70 | 1180 |

TABLE 10

| Sample No. | Overall composition, mass % | | | | | | | | Wear amount, μm | | |
|---|---|---|---|---|---|---|---|---|---|---|---|
| | Fe | Mo | Co | Si | Cr | V | W | C | Valve seat | Valve | Total |
| 65 | Balance | 15.22 | 9.25 | 0.75 | 3.30 | 0.40 | 1.20 | 0.90 | 150 | 2 | 152 |
| 66 | Balance | 16.02 | 9.25 | 0.75 | 3.30 | 1.00 | 1.20 | 0.90 | 65 | 3 | 68 |
| 43 | Balance | 16.22 | 9.25 | 0.75 | 3.30 | 0.40 | 1.20 | 0.90 | 55 | 3 | 58 |
| 67 | Balance | 16.82 | 9.25 | 0.75 | 3.30 | 1.00 | 1.20 | 0.90 | 60 | 3 | 63 |
| 68 | Balance | 17.22 | 9.25 | 0.75 | 3.30 | 0.40 | 1.20 | 0.90 | 80 | 50 | 130 |
| 69 | Balance | 16.22 | 9.25 | 0.75 | 2.50 | — | — | 0.90 | 160 | 2 | 162 |
| 70 | Balance | 16.22 | 9.25 | 0.75 | 2.90 | 0.10 | 0.80 | 0.90 | 76 | 3 | 79 |
| 71 | Balance | 16.22 | 9.25 | 0.75 | 3.70 | 0.60 | 1.60 | 0.90 | 62 | 18 | 80 |
| 72 | Balance | 16.22 | 9.25 | 0.75 | 3.90 | 0.80 | 2.00 | 0.90 | 115 | 60 | 175 |
| 73 | Balance | 16.22 | 9.25 | 0.75 | 3.30 | 0.40 | 1.20 | 0.78 | 130 | 2 | 132 |
| 74 | Balance | 16.22 | 9.25 | 0.75 | 3.30 | 0.40 | 1.20 | 0.82 | 76 | 2 | 78 |
| 75 | Balance | 16.22 | 9.25 | 0.75 | 3.30 | 0.40 | 1.20 | 0.94 | 60 | 10 | 70 |
| 76 | Balance | 16.22 | 9.25 | 0.75 | 3.30 | 0.40 | 1.20 | 1.02 | 105 | 38 | 143 |
| 77 | Balance | 16.22 | 9.25 | 0.75 | 2.50 | — | — | 0.70 | 160 | 2 | 162 |
| 78 | Balance | 16.22 | 9.25 | 0.75 | 2.70 | 0.10 | 0.30 | 0.75 | 94 | 2 | 96 |
| 79 | Balance | 16.22 | 9.25 | 0.75 | 2.90 | 0.20 | 0.60 | 0.80 | 80 | 3 | 83 |
| 80 | Balance | 16.22 | 9.25 | 0.75 | 3.10 | 0.30 | 0.90 | 0.85 | 62 | 3 | 65 |
| 81 | Balance | 16.22 | 9.25 | 0.75 | 3.50 | 0.50 | 1.50 | 0.95 | 54 | 4 | 58 |
| 82 | Balance | 16.22 | 9.25 | 0.75 | 3.70 | 0.60 | 1.80 | 1.00 | 60 | 16 | 76 |
| 83 | Balance | 16.22 | 9.25 | 0.75 | 3.90 | 0.70 | 2.10 | 1.05 | 110 | 54 | 164 |

Referring now to FIG. 16 to FIG. 19, test results are discussed.

(Relationship between Wear and Mo Amount in Alloy Powder C)

Figure 16:
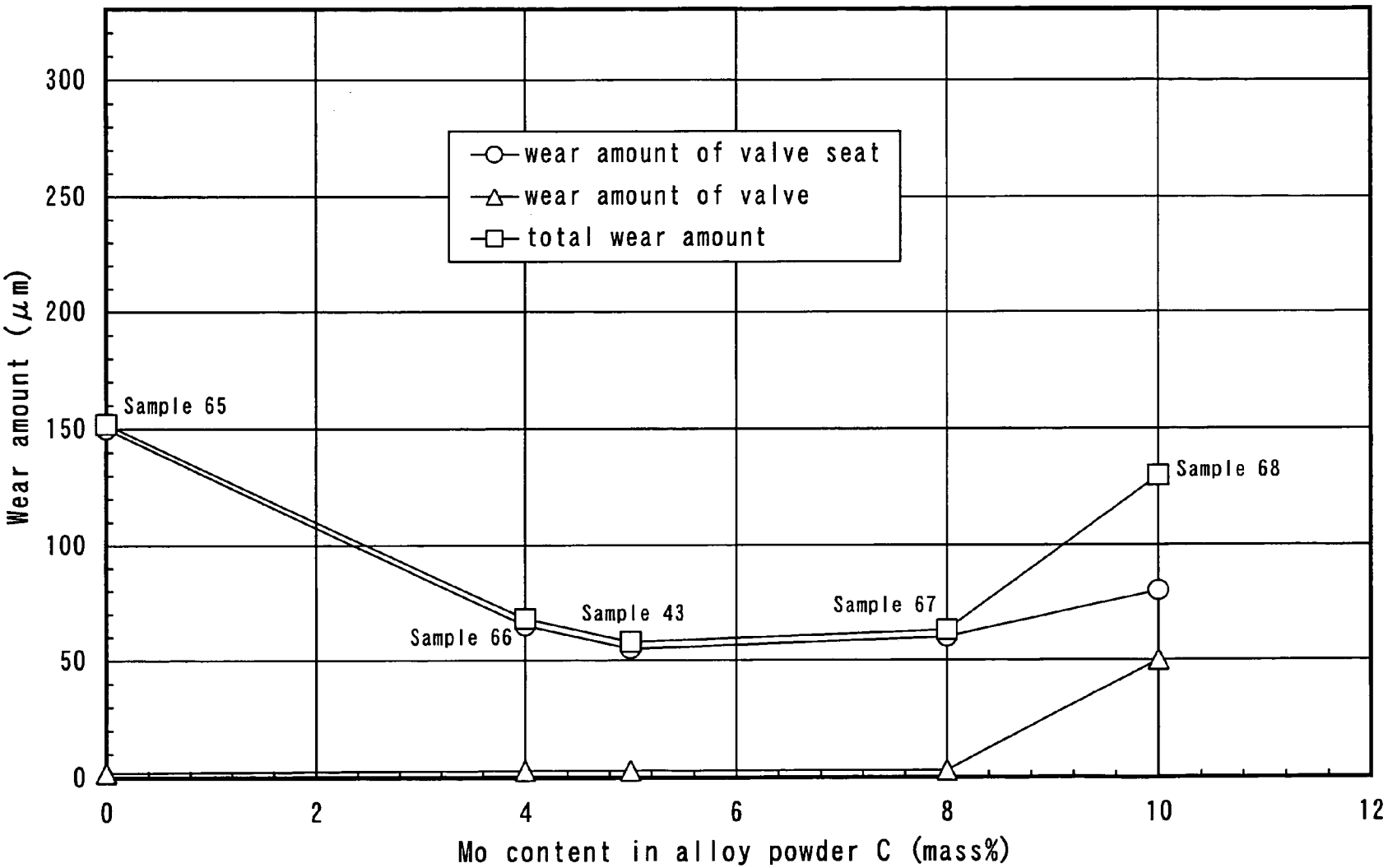
FIG. 16 is a graph of the relationship of wear and Mo amount in alloy powder C.

As shown in FIG. 16, in sintered alloys (samples 43, 66 and 67) in which the Mo content in the alloy C is in a range of 4 to 8 mass %, the wear amounts of the valve seat and the valves are stable and low, and a favorable wear resistance is exhibited. On the other hand, in sintered alloys (samples 65 and 68) in which the Mo content is out of the range of 4 to 8 mass %, in particular, the wear amount of the valve seats is significantly high. It has been therefore confirmed that an excellent wear resistance is realized as long as the Mo content in alloy powder C is in a range of 4 to 8 mass %.

(Relationship between Wear and Amount of Alloying Elements (V, W, Cr) in Alloy Powder C)

Figure 17:
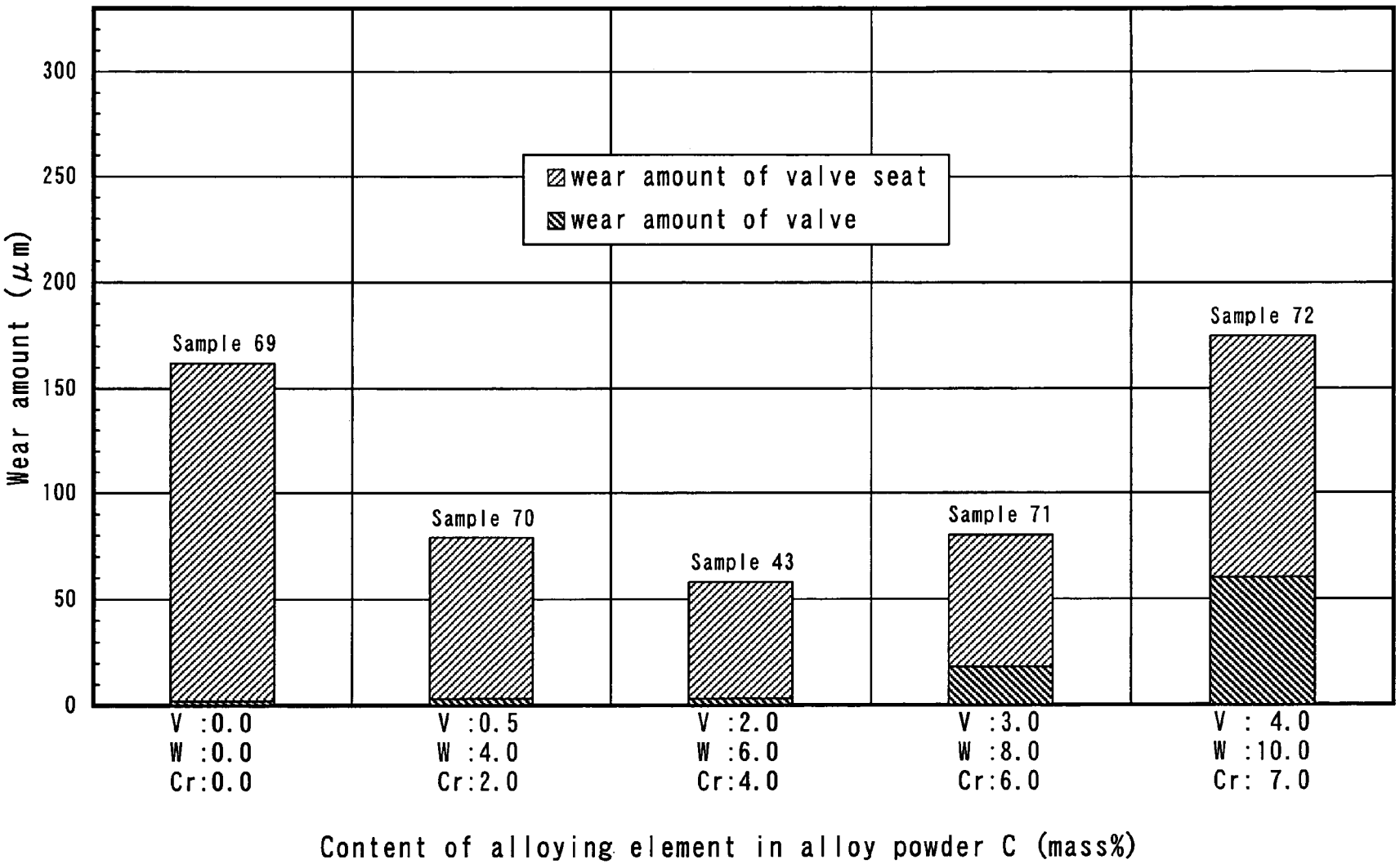
FIG. 17 is a graph of the relationship of wear and amount of alloy elements (V, W, Cr) in alloy powder C.

As shown in FIG. 17, in sintered alloys (samples 43, 70 and 71) in which the content of alloying elements in alloy powder C is in a range of V: 0.5 to 3 mass %, W: 4 to 8 mass %, and Cr: 2 to 6 mass %, the wear amounts of the valve seats and the valves are stable and low, and favorable wear resistance was exhibited. On the other hand, in sintered alloys (samples 69 and 72) in which the content of alloying elements in alloy powder C is out of the range of V: 0.5 to 3 mass %, W: 4 to 8 mass %, and Cr: 2 to 6 mass %, in particular, the wear amounts of valve seats was significantly high. It has been therefore confirmed that an excellent wear resistance is realized as long as the content of alloying elements in alloy powder C is in a range of V: 0.5 to 3 mass %, W: 4 to 8 mass %, and Cr: 2 to 6 mass %.

(Relationship between Wear and C Amount in Alloy Powder C)

Figure 18:
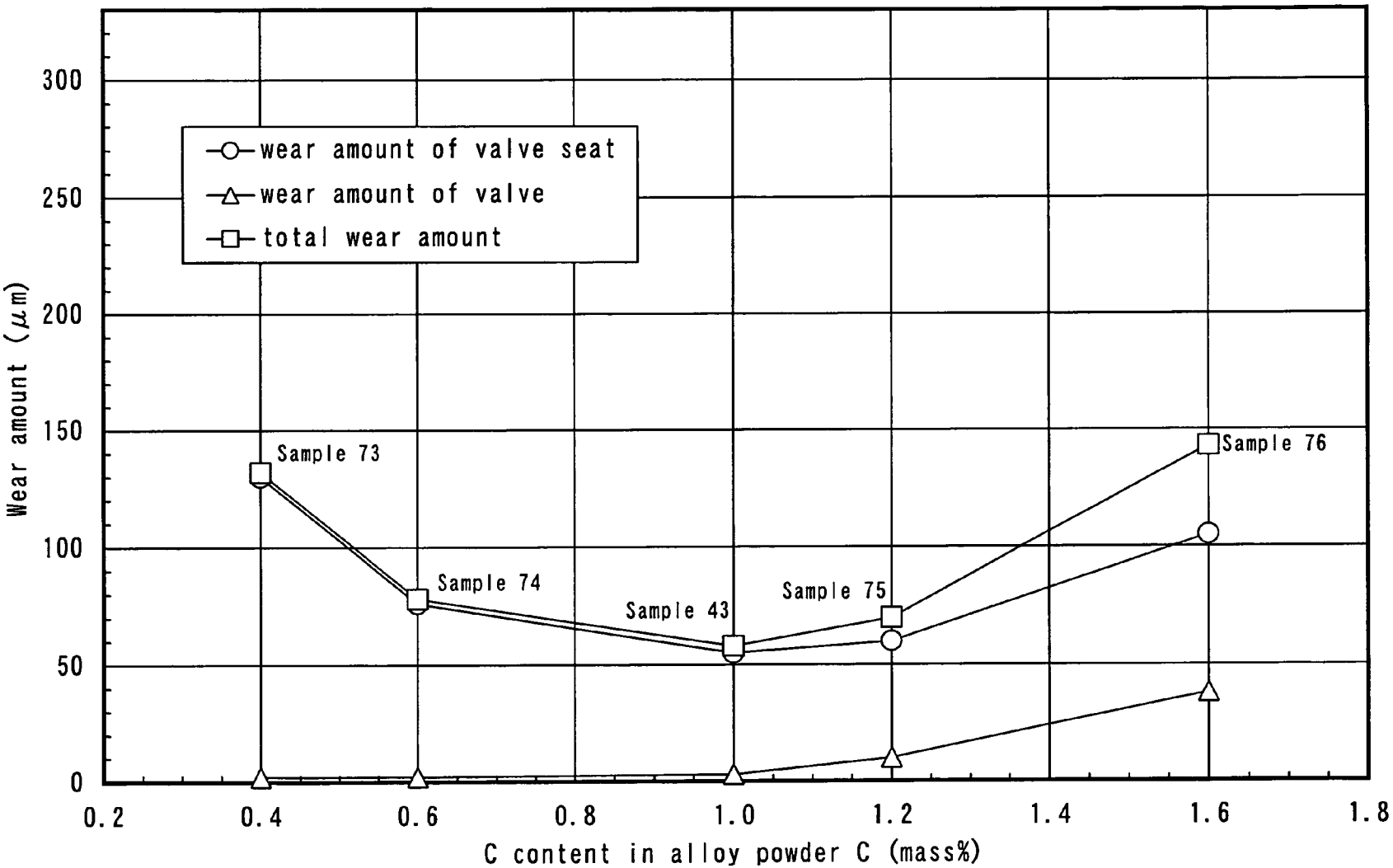
FIG. 18 is a graph of the relationship of wear and C amount in alloy powder C.

As shown in FIG. 18, in sintered alloys (samples 43, 74 and 75) in which the C content in the alloy powder C is in a range of 0.6 to 1.2 mass %, the wear amounts of the valve seats and the valves were stable and low, and favorable wear resistance was exhibited. On the other hand, in sintered alloys (samples 73 and 76) in which the C content is out of the range of 0.6 to 1.2 mass %, in particular, the wear amounts of valve seats are significantly high. It has been therefore confirmed that an excellent wear resistance is realized as long as the C content in alloy powder C is in a range of 0.6 to 1.2 mass %.

(Relationship between Wear and Content of Alloy Powder C)

Figure 19:
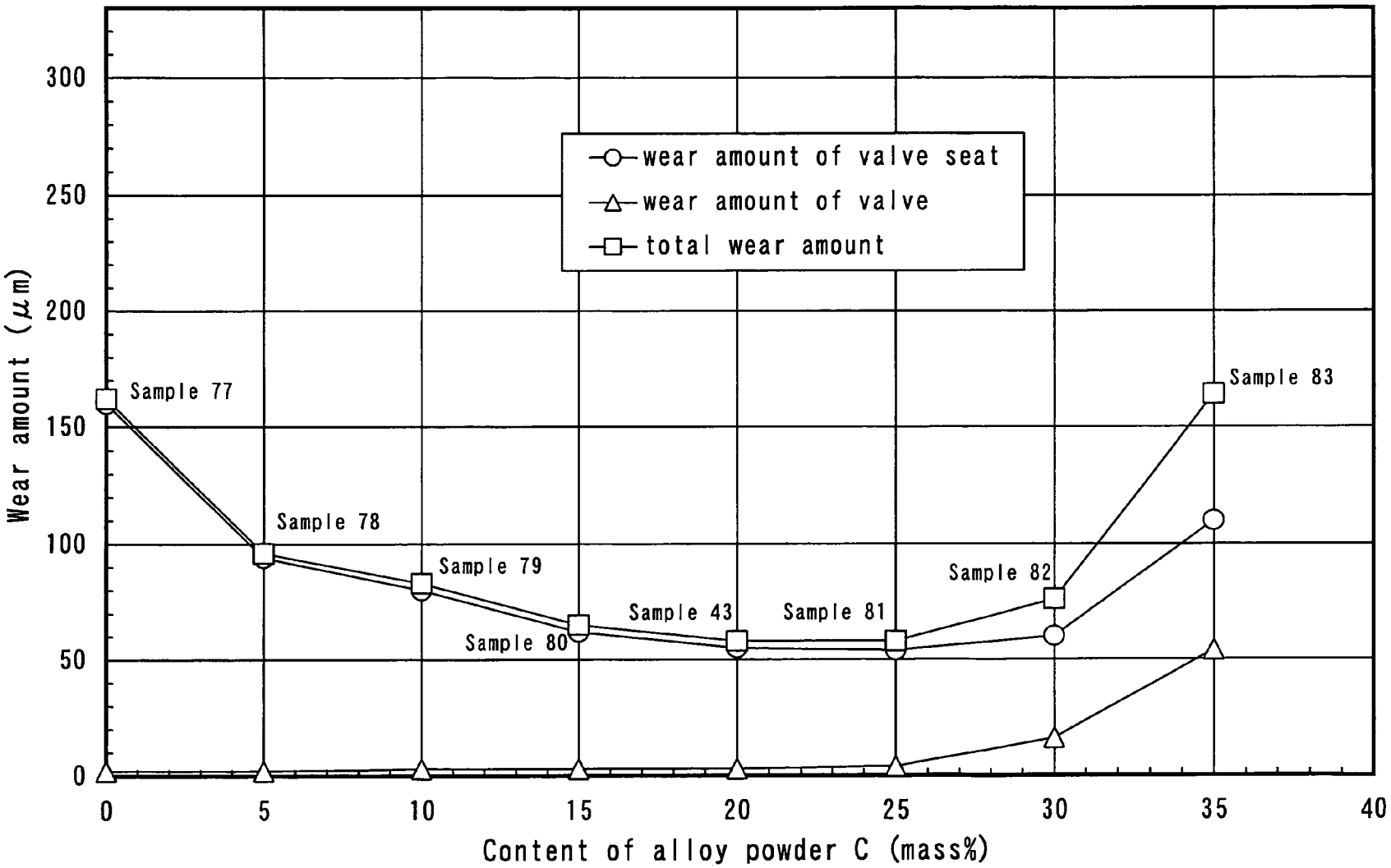
FIG. 19 is a graph of the relationship of wear and content of alloy powder C.

As shown in FIG. 19, in sintered alloys (samples 43 and 78 to 82) in which the content of alloy powder C in the overall mass of mixed powder is in a range of 5 to 30 mass %, the wear amounts of the valve seats and the valves were stable and low, and favorable wear resistance was exhibited. On the other hand, in sintered alloys (samples 77 and 83) in which the content of the alloy powder C is out of the range of 5 to 30 mass %, in particular, the wear amounts of valve seats were significantly high. It has been therefore confirmed that an excellent wear resistance is realized as long as the content of alloy powder C in the overall mass of mixed powder is in a range of 5 to 30 mass %.

Embodiment 8

Effects of Addition of Ni Powder

Alloy powder A for forming the matrix, alloy powder B for forming the Co base hard phase, alloy powder C for forming the Fe base hard phase, Ni powder, and graphite powder shown in Table 11 were blended at the rate specified in Table 11, together with forming lubricant (0.8 mass % of zinc stearate), and the mixed powder was formed in a ring of ϕ30 (mm)×ϕ20 (mm)×h10 (mm) at a forming pressure of 650 MPa. These formed bodies were sintered under the same condition as in embodiment 5, and samples 43 and 84 to 88 in the compositions as shown in Table 12 were prepared. In these samples, simplified wear tests were conducted as in embodiment 5, and the results are shown in Table 12.

TABLE 11

| | Blending ratio, mass % | | | | | |
|---|---|---|---|---|---|---|
| Sample No. | Alloy powder A Fe—5Mo | Alloy powder B Fe—50Mo—3Si—10Cr | Alloy powder C Fe—5Mo—2V—6W—4Cr—1C | Ni powder | Graphite powder | Sintering temperature ° C. |
| 43 | Balance | 25.00 | 20.00 | — | 0.70 | 1180 |
| 84 | Balance | 25.00 | 20.00 | 3.00 | 0.70 | 1180 |
| 85 | Balance | 25.00 | 20.00 | 5.00 | 0.70 | 1180 |
| 86 | Balance | 25.00 | 20.00 | 10.00 | 0.70 | 1180 |
| 87 | Balance | 25.00 | 20.00 | 13.00 | 0.70 | 1180 |
| 88 | Balance | 25.00 | 20.00 | 15.00 | 0.70 | 1180 |

TABLE 12

| Sample | Overall composition, mass % | | | | | | | | | Wear amount, μm | | |
|---|---|---|---|---|---|---|---|---|---|---|---|---|
| | | | | | | | | | | Valve | | |
| No. | Fe | Mo | Co | Si | Cr | V | W | C | Ni | seat | Valve | Total |
| 43 | Balance | 16.22 | 9.25 | 0.75 | 3.30 | 0.40 | 1.20 | 0.90 | — | 55 | 3 | 58 |
| 84 | Balance | 16.07 | 9.25 | 0.75 | 3.30 | 0.40 | 1.20 | 0.90 | 3.00 | 36 | 6 | 42 |
| 85 | Balance | 15.97 | 9.25 | 0.75 | 3.30 | 0.40 | 1.20 | 0.90 | 5.00 | 31 | 7 | 38 |
| 86 | Balance | 15.72 | 9.25 | 0.75 | 3.30 | 0.40 | 1.20 | 0.90 | 10.00 | 28 | 12 | 40 |
| 87 | Balance | 15.57 | 9.25 | 0.75 | 3.30 | 0.40 | 1.20 | 0.90 | 13.00 | 40 | 9 | 49 |
| 88 | Balance | 15.47 | 9.25 | 0.75 | 3.30 | 0.40 | 1.20 | 0.90 | 15.00 | 105 | 6 | 111 |

Figure 20:
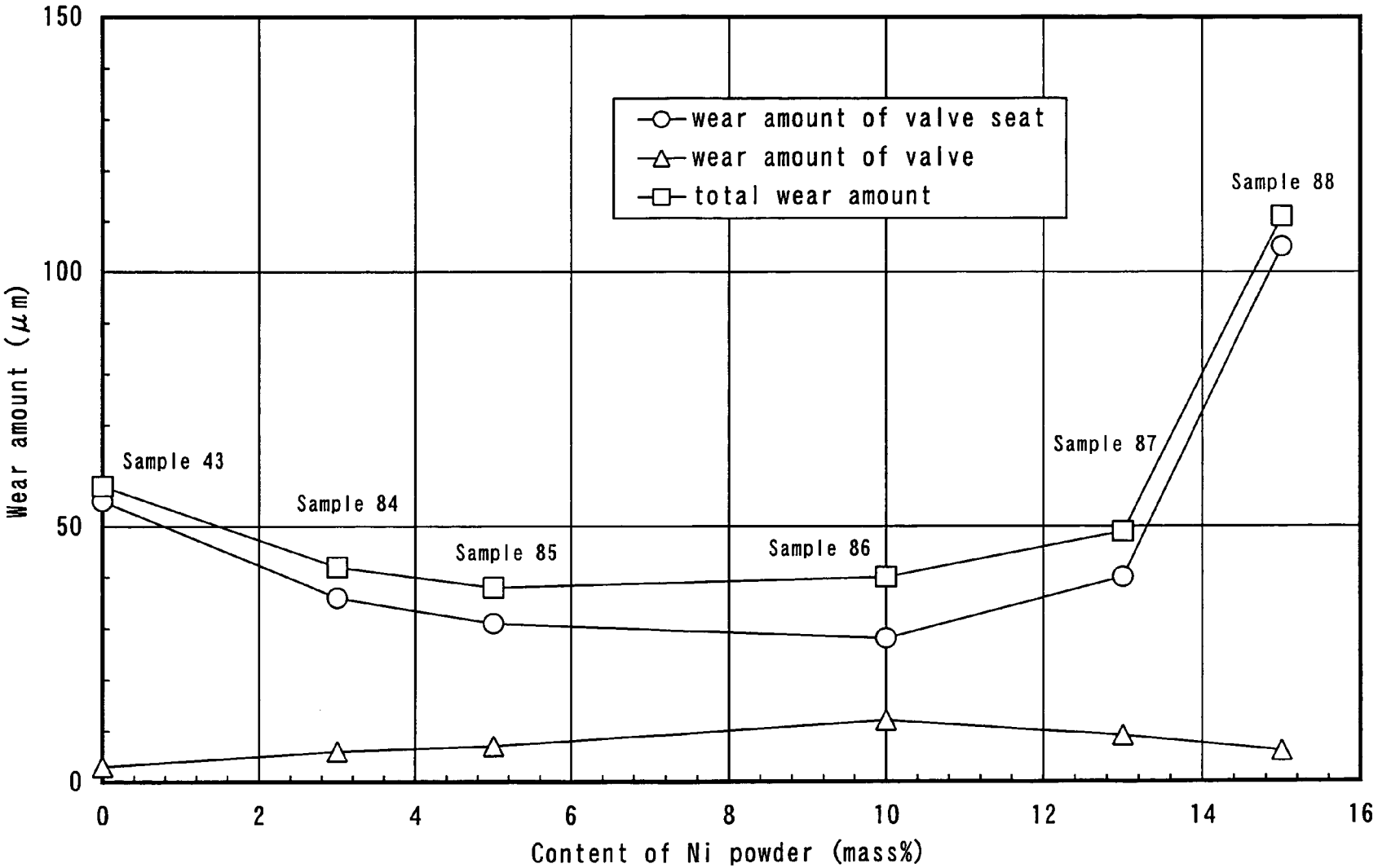
FIG. 20 is a graph of the relationship of wear and content of Ni powder.

Referring now to FIG. 20, test results are discussed.

(Relationship between Wear and Content of Ni Powder)

As shown in FIG. 20, in sintered alloys (samples 43 and 84 to 87) in which the content of the Ni powder is in a range of 13 mass % or less, the wear amounts of the valve seats and valves are stable and low, and favorable wear resitance was exhibited. On the other hand, in sintered alloy (sample 88) in which the content of the Ni powder is out of the range of 13 mass % or less, and in particular, the wear amounts of the valve seats were significantly high. It has been therefore confirmed that excellent wear resistance is realized as long as the content of the Ni powder is in a range of 13 mass % or less.

Embodiment 9

Effects of Addition of Graphite Powder

Alloy powder A for forming the matrix, alloy powder B for forming the Co base hard phase, alloy powder C for forming the Fe base hard phase, and graphite powder shown in Table 13 were blended at the rates specified in Table 13, together with forming lubricant (0.8 mass % of zinc stearate), and the mixed powder was formed in a ring of ϕ30 (mm)×ϕ20 (mm)×h10 (mm) at a forming pressure of 650 MPa. These formed bodies were sintered under the same condition as in embodiment 5, and samples 43 and 89 to 94 in the composition as shown in Table 14 were prepared. In these samples, simplified wear tests were conducted as in embodiment 5, and the results are shown in Table 14.

Figure 21:
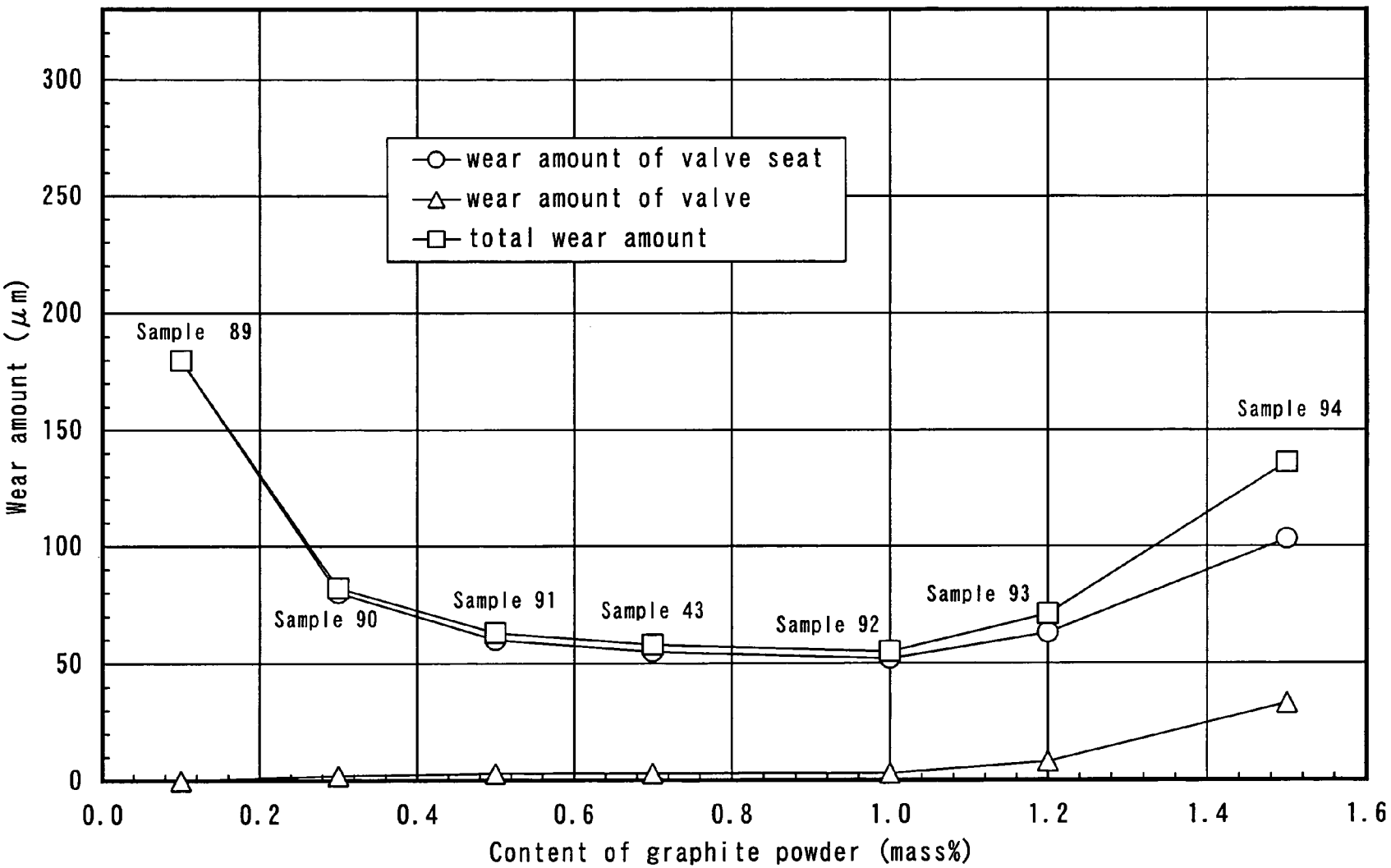
FIG. 21 is a graph of the relationship of wear and content of graphite powder.

Referring now to FIG. 21, test results are discussed.

(Relationship between Wear and Content of Graphite Powder)

As shown in FIG. 21, in sintered alloys (samples 43 and 90 to 93) in which content of graphite powder is in a range of 0.3 to 1.2 mass %, the wear amounts of the valve seats and valves were stable and low, and favorable wear resistance was exhibited. On the other hand, in sintered alloys (samples 89 and 94) in which the content of graphite powder is out of the range of 0.3 to 1.2 mas%, in particular, the wear amounts of the valve seats were significantly high. It has been therefore confirmed that excellent wear resistance is realized as long as the content of graphite powder is in a range of 0.3 to 1.2 mass %.

Embodiment 10

Effects of Sintering Temperature

Alloy powder A for forming the matrix, alloy powder B for forming the Co base hard phase, alloy powder C for forming the Fe base hard phase, and graphite powder shown in Table 15 were blended at the rates specified in Table 15, together with forming lubricant (0.8 mass % of zinc stearate), and the mixed powder was formed in a ring of ϕ30 (mm)×ϕ20 (mm)×h10 (mm) at a forming pressure of 650 MPa. These formed bodies were sintered under the same conditions as in embodiment 5, and samples 43 and 95 to 99 in the composition as shown in Table 16 were prepared. In these samples, simplified wear tests were conducted as in embodiment 5, and the results are shown in Table 16.

TABLE 13

| | Blending ratio, mass % | | | | |
|---|---|---|---|---|---|
| Sample No. | Alloy powder A Fe—5Mo | Alloy powder B Fe—50Mo—3Si—10Cr | Alloy powder C Fe—5Mo—2V—6W—4Cr—1C | Graphite powder | Sintering temperature ° C. |
| 89 | Balance | 25.00 | 20.00 | 0.10 | 1180 |
| 90 | Balance | 25.00 | 20.00 | 0.30 | 1180 |
| 91 | Balance | 25.00 | 20.00 | 0.50 | 1180 |
| 43 | Balance | 25.00 | 20.00 | 0.70 | 1180 |
| 92 | Balance | 25.00 | 20.00 | 1.00 | 1180 |
| 93 | Balance | 25.00 | 20.00 | 1.20 | 1180 |
| 94 | Balance | 25.00 | 20.00 | 1.50 | 1180 |

TABLE 14

| Sample | Overall composition, mass % | | | | | | | | Wear amount, μm | | |
|---|---|---|---|---|---|---|---|---|---|---|---|
| No. | Fe | Mo | Co | Si | Cr | V | W | C | Valve seat | Valve | Total |
| 89 | Balance | 16.25 | 9.25 | 0.75 | 3.30 | 0.40 | 1.20 | 0.30 | 180 | 0 | 180 |
| 90 | Balance | 16.24 | 9.25 | 0.75 | 3.30 | 0.40 | 1.20 | 0.50 | 80 | 2 | 82 |
| 91 | Balance | 16.23 | 9.25 | 0.75 | 3.30 | 0.40 | 1.20 | 0.70 | 60 | 3 | 63 |
| 43 | Balance | 16.22 | 9.25 | 0.75 | 3.30 | 0.40 | 1.20 | 0.90 | 55 | 3 | 58 |
| 92 | Balance | 16.20 | 9.25 | 0.75 | 3.30 | 0.40 | 1.20 | 1.20 | 52 | 3 | 55 |
| 93 | Balance | 16.19 | 9.25 | 0.75 | 3.30 | 0.40 | 1.20 | 1.40 | 63 | 8 | 71 |
| 94 | Balance | 16.19 | 9.25 | 0.75 | 3.30 | 0.40 | 1.20 | 1.70 | 103 | 33 | 136 |

TABLE 15

| Sample No. | Blending ratio, mass % Alloy powder A Fe—5Mo | Alloy powder B Fe—50Mo—3Si—10Cr | Alloy powder C Fe—5Mo—2V—6W—4Cr—1C | Graphite powder | Sintering temperature ° C. |
|---|---|---|---|---|---|
| 95 | Balance | 25.00 | 20.00 | 0.70 | 900 |
| 96 | Balance | 25.00 | 20.00 | 0.70 | 1000 |
| 97 | Balance | 25.00 | 20.00 | 0.70 | 1100 |
| 43 | Balance | 25.00 | 20.00 | 0.70 | 1180 |
| 98 | Balance | 25.00 | 20.00 | 0.70 | 1200 |
| 99 | Balance | 25.00 | 20.00 | 0.70 | 1230 |

TABLE 16

| Sample | Overall composition, mass % | | | | | | | | Wear amount, μm | | |
|---|---|---|---|---|---|---|---|---|---|---|---|
| No. | Fe | Mo | Co | Si | Cr | V | W | C | Valve seat | Valve | Total |
| 95 | Balance | 16.22 | 9.25 | 0.75 | 3.30 | 0.40 | 1.20 | 0.90 | 280 | 0 | 280 |
| 96 | Balance | 16.22 | 9.25 | 0.75 | 3.30 | 0.40 | 1.20 | 0.90 | 85 | 2 | 87 |
| 97 | Balance | 16.22 | 9.25 | 0.75 | 3.30 | 0.40 | 1.20 | 0.90 | 65 | 2 | 67 |
| 43 | Balance | 16.22 | 9.25 | 0.75 | 3.30 | 0.40 | 1.20 | 0.90 | 55 | 3 | 58 |
| 98 | Balance | 16.22 | 9.25 | 0.75 | 3.30 | 0.40 | 1.20 | 0.90 | 50 | 3 | 53 |
| 99 | Balance | 16.22 | 9.25 | 0.75 | 3.30 | 0.40 | 1.20 | 0.90 | 184 | 3 | 187 |

Figure 22:
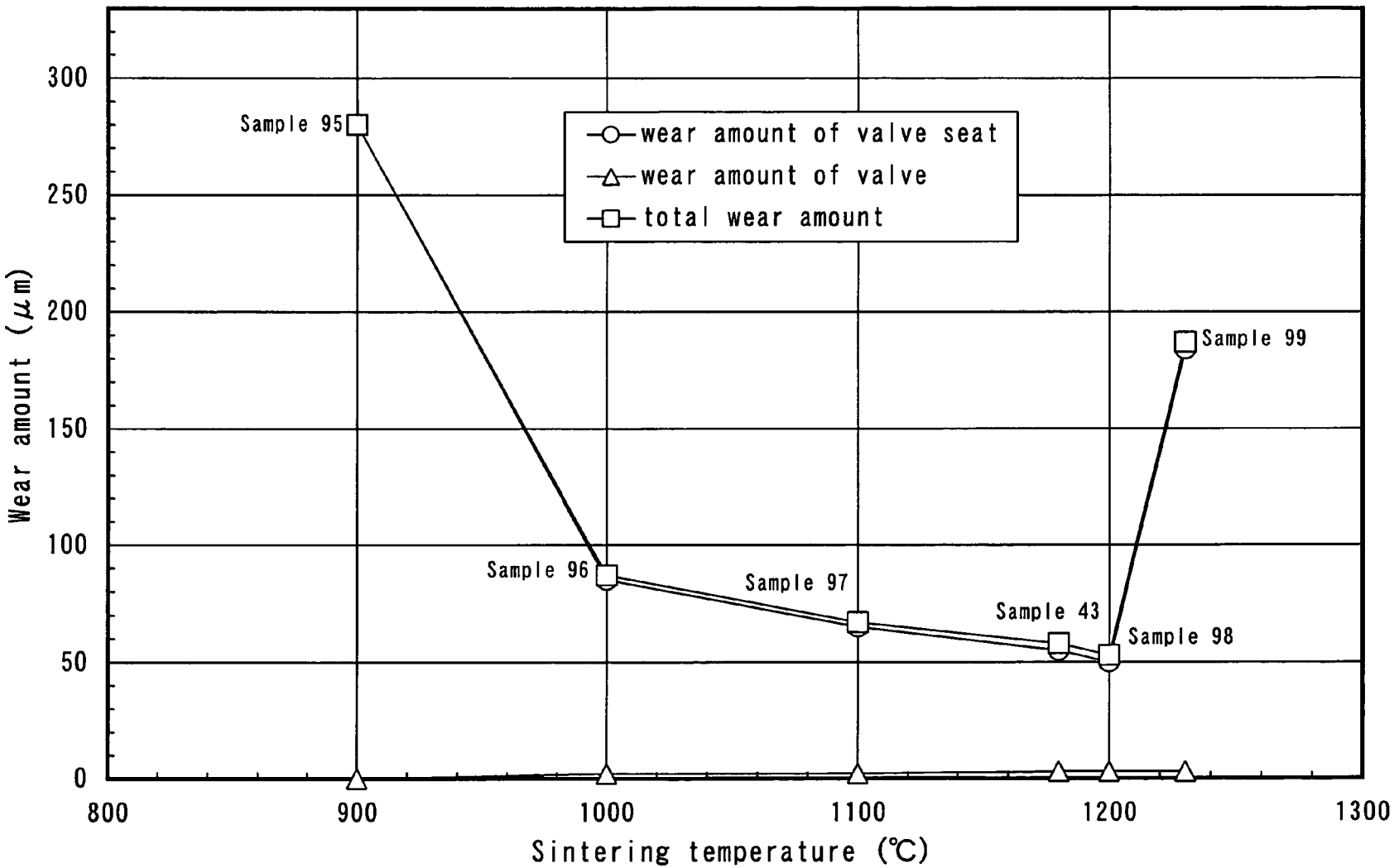
FIG. 22 is a graph of the relationship of wear and sintering temperature.

Referring now to FIG. 22, test results are discussed.

(Relationship between Wear and Sintering Temperature)

As shown in FIG. 22, in sintered alloys (samples 43 and 96 to 98) in which sintering temperature is in a range of 1000 to 1200° C., the wear amounts of the valve seats and valves were stable and low, and favorable wear resistance was exhibited. On the other hand, in sintered alloys (samples 95 and 99) in which the sintering temperature was out of the range of 1000 to 1200° C., in particular, the wear amounts of valve seats were significantly high. It has been therefore confirmed that an excellent wear resistance is realized as long as the sintering temperature is in a range of 1000 to 1200° C.

What is claimed is:

1. A wear resistant sintered alloy consisting of Mo: 5.26 to 28.47 mass %, Co: 1.15 to 19.2 mass %, Cr: 0.25 to 6.6 mass %, Si: 0.05 to 2.0 mass %, V: 0.03 to 0.9 mass %, W: 0.2 to 2.4 mass % and C: 0.43 to 1.56 mass %, and the balance of Fe and inevitable impurities, wherein 5 to 40 mass % of Co base hard phase and 5 to 30 mass % of Fe base hard phase are dispersed in a matrix of a bainite phase or a mixed phase of bainite and martensite, wherein a precipitated material mainly composed of Mo silicide is integrally precipitating in the Co base hard phase, and wherein granular Cr carbide, Mo carbide, V carbide and W carbide are precipitated and dispersed in the Fe base hard phase.

2. A wear resistant sintered alloy consisting of: Mo: 4.87 to 28.47 mass %, Co: 1.15 to 19.2 mass %, Cr: 0.25 to 6.6 mass %, Si: 0.05 to 2.0 mass %, V: 0.03 to 0.9 mass %, W: 0.2 to 2.4 mass %, C: 0.43 to 1.56 mass %, and Ni: 13 mass % or less, and the balance of Fe and inevitable impurities, wherein 5 to 40 mass % of Co base hard phase and 5 to 30 mass % of Fe base hard phase are dispersed in a matrix of a bainite phase or a mixed phase of martensite and austenite, wherein a precipitated material mainly composed of Mo silicide is integrally precipitating in the Co base hard phase, and wherein granular Cr carbide, Mo carbide, V carbide and W carbide are precipitated and dispersed in the Fe base hard phase.

3. The wear resistant sintered alloy according to claim 1, wherein 0.3 to 2.0 mass % of at least one type of machinability improving particles selected from the group consisting of lead, molybdenum disulfide, manganese sulfide, boron nitride, magnesium metasilicate mineral and calcium fluoride is dispersed in the matrix structure.

4. The wear resistant sintered alloy according to claim 2, wherein 0.3 to 2.0 mass % of at least one type of machinability improving particles selected from the group consisting of lead, molybdenum disulfide, manganese sulfide, boron nitride, magnesium metasilicate mineral and calcium fluoride is dispersed in the matrix structure.

5. The wear resistant sintered alloy according to claim 1, wherein pores are filled with at least one type selected from the group consisting of lead, lead alloy, copper, copper alloy and acrylic resin.

6. The wear resistant sintered alloy according to claim 2, wherein pores are filled with at least one type selected from the group consisting of lead, lead alloy, copper, copper alloy and acrylic resin.

7. The wear resistant sintered alloy according to claim 1, wherein 0.3 to 2.0 mass % of at least one type of machinability improving particles selected from the group consisting of lead, molybdenum disulfide, manganese sulfide, boron nitride, magnesium metasilicate mineral and calcium fluoride is dispersed in the matrix structure; and wherein pores are filled with at least one type selected from the group consisting of lead, lead alloy, copper, copper alloy and acrylic resin.

8. The wear resistant sintered alloy according to claim 6, wherein 0.3 to 2.0 mass % of at least one type of machinability improving particles selected from the group consisting of lead, molybdenum disulfide, manganese sulfide, boron nitride, magnesium metasilicate mineral and calcium fluoride is dispersed in the matrix structure; and wherein pores are filled with at least one type selected from the group consisting of lead, lead alloy, copper, copper alloy and acrylic resin.

* * * * *